US011738444B2

(12) United States Patent
Samsel et al.

(10) Patent No.: US 11,738,444 B2
(45) **Date of Patent: *Aug. 29, 2023**

(54) STORAGE CHEST WITH SECONDARY STORAGE COMPARTMENT

(71) Applicant: APEX BRANDS INC., Apex, NC (US)

(72) Inventors: Richard A. Samsel, Haines City, FL (US); Jonathan Eziquiel-Shriro, St. Louis, MO (US); Matthew Poppe, Holly Springs, NC (US); Jason Mars, Jonesboro, AR (US); Michael Taber, Jonesboro, AR (US)

(73) Assignee: APEX BRANDS, INC., Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/715,348

(22) Filed: Apr. 7, 2022

(65) Prior Publication Data

US 2022/0241956 A1 Aug. 4, 2022

Related U.S. Application Data

(63) Continuation of application No. 16/548,174, filed on Aug. 22, 2019, now Pat. No. 11,318,599.

(Continued)

(51) Int. Cl.
*B25H 3/02* (2006.01)
*A47B 67/00* (2006.01)

(Continued)

(52) U.S. Cl.
CPC ..... *B25H 3/025* (2013.01); *A47B 67/00* (2013.01); *B65D 19/02* (2013.01); *B65D 25/04* (2013.01);

(Continued)

(58) Field of Classification Search
CPC ..... B25H 3/025; B65D 43/16; B65D 43/22; B65D 19/02; B65D 2519/00059;

(Continued)

(56) References Cited

U.S. PATENT DOCUMENTS

D70,897 S 8/1926 Purchas
D117,837 S 11/1939 Tuttle (Continued)

FOREIGN PATENT DOCUMENTS

CN 207359024 U * 5/2018

OTHER PUBLICATIONS

Rigid 48 ×24 in Universal Storage Chest, printed on Jul. 8, 2019 from https://www.homedepot.com/p/RIDGID-48-in-x-24-in-Universal-Storage-Chest-4BR-OS/300748574, all enclosed pages cited.

(Continued)

*Primary Examiner* — Matthew W Ing
(74) *Attorney, Agent, or Firm* — BURR & FORMAN LLP

(57) ABSTRACT

An example storage chest is provided. The example storage chest may include a box portion and a lid. The box portion may include a front wall, a rear wall, and a floor attached to the front and rear walls to form a primary compartment for storage of items. The lid may include a front panel, a rear panel, and a top panel attached to the front a rear panels. The rear panel may be pivotably coupled to the rear wall of the box portion. The front panel, the rear panel, and the top panel may define a secondary compartment within the lid for storage of items. The secondary compartment may include a lid storage compartment comprising a hingedly affixed door.

24 Claims, 28 Drawing Sheets

Related U.S. Application Data

(60) Provisional application No. 62/722,611, filed on Aug. 24, 2018.

(51) Int. Cl.
*B65D 25/04* (2006.01)
*B65D 43/22* (2006.01)
*B65D 19/02* (2006.01)
*B65D 43/16* (2006.01)

(52) U.S. Cl.
CPC ..... *B65D 43/16* (2013.01); *B65D 43/22* (2013.01); *B65D 2543/00018* (2013.01)

(58) Field of Classification Search
CPC ..... B65D 2519/00164; B65D 2519/00199; B65D 2543/00018; B65D 25/04; A47B 67/00
USPC ..... 312/295
See application file for complete search history.

(56) References Cited

U.S. PATENT DOCUMENTS

| | | | | |
|---|---|---|---|---|
| D192,848 | S | 5/1962 | Hageal et al. | |
| 3,459,327 | A * | 8/1969 | Harris | F42B 39/00 220/520 |
| 4,288,134 | A | 9/1981 | Knaack et al. | |
| D264,641 | S | 6/1982 | Evans et al. | |
| 4,368,935 | A * | 1/1983 | White | B42F 15/063 312/189 |
| 4,447,099 | A * | 5/1984 | French | A47B 61/00 16/382 |
| D294,308 | S | 2/1988 | Charton | |
| 5,794,385 | A * | 8/1998 | Donovan | A01K 1/035 49/70 |
| D410,350 | S | 6/1999 | Stangl | |
| D421,181 | S | 2/2000 | Tisbo et al. | |
| D456,134 | S | 4/2002 | Buck | |
| D467,730 | S | 12/2002 | Ekerot et al. | |
| 7,418,846 | B2 | 9/2008 | James et al. | |
| D579,658 | S | 11/2008 | Weng et al. | |
| D580,653 | S | 11/2008 | Robaina | |
| D611,252 | S | 3/2010 | Fiscus | |
| 8,096,152 | B2 | 1/2012 | Wagh et al. | |
| D664,767 | S | 8/2012 | Shewmaker | |
| D665,194 | S | 8/2012 | Lenney | |
| D672,553 | S | 12/2012 | Devilier | |
| 8,567,459 | B2 | 10/2013 | Kitchen | |
| D727,622 | S | 4/2015 | Hile | |
| D728,279 | S | 5/2015 | Punzell | |
| D740,562 | S | 10/2015 | Bonilla | |
| D749,845 | S | 2/2016 | Tonelli | |
| D766,020 | S | 9/2016 | Thatcher | |
| D859,832 | S | 9/2019 | Bokros | |
| D859,833 | S | 9/2019 | Bokros | |
| D862,881 | S | 10/2019 | Milburn | |
| 11,318,599 | B2 * | 5/2022 | Samsel | B65D 55/14 |
| 2002/0162842 | A1 | 11/2002 | Pangerc et al. | |
| 2006/0230795 | A1 | 10/2006 | Kroening | |
| 2008/0110893 | A1 | 5/2008 | Cowie et al. | |
| 2012/0012590 | A1 | 1/2012 | Earp | |
| 2013/0200762 | A1 * | 8/2013 | Schleicher | A47B 73/00 312/213 |
| 2017/0233155 | A1 * | 8/2017 | Daws, II | B65D 55/14 220/324 |
| 2019/0241349 | A1 | 8/2019 | Pearson et al. | |

OTHER PUBLICATIONS

Office Action from related U.S. Appl. No. 16/548,174 dated Jul. 20, 2021, all pages cited in its entirety.

* cited by examiner

STORAGE CHEST WITH SECONDARY STORAGE COMPARTMENT

CROSS REFERENCE TO RELATED APPLICATION

This application is a continuation of U.S. application Ser. No. 16/548,174 filed on Aug. 22, 2019, which claims priority to U.S. application No. 62/722,611 filed Aug. 24, 2018, the entire contents of which are hereby incorporated by reference in its entirety.

TECHNICAL FIELD

Example embodiments generally relate to storage chests, and in particular relate to storage chests with hinged lids.

BACKGROUND

Large, heavy-duty storage chests are often used in the construction industry, for example, to secure tools and other valuable items at a construction site. Such storage chests, or work-site chests, are typically steel containers that are lockable to secure the contents. Often the chests are moved to the construction site, via a forklift or crane, to allow tools and other valuable items to be stored and secured at location convenient for construction workers, such that the tools and other valuable items can be stored overnight or otherwise when the tools stored in the chest are not in use. As such, use of the chests eliminates the need to transport tools back and forth to the work site each day and are particularly effective in locations where vehicle access is limited or unavailable.

The interior of the storage chests typically comprises an interior, empty cavity. Tools and other supplies or items may be placed into the interior cavity of the chest in no particular manner, and are often even tossed or thrown into the chest. As such, the contents of the interior of the chest can become cluttered and disorganized over time, making it difficult for construction workers to find desired items within the chests, particularly when the desired items are smaller items. Additionally, once the chest is unlocked and opened, access is provided to the entirety of the internal cavity. The lack organization and security of the unlocked chest can lead to lost time on the construction site, while desired items are being located and removed from the chest. As such, innovations that limit or prevent disorganization of the contents of the chest would be beneficial.

BRIEF SUMMARY OF SOME EXAMPLES

An example storage chest is provided. The example storage chest may include a box portion and a lid. The box portion may include a front wall, a rear wall, and a floor attached to the front and rear walls to form a primary compartment for storage of items. The lid may include a front panel, a rear panel, and a top panel attached to the front a rear panels. The rear panel may be pivotably coupled to the rear wall of the box portion. The front panel, the rear panel, and the top panel may define a secondary compartment within the lid for storage of items. The secondary compartment may include a lid storage compartment comprising a hingedly affixed door.

Another example storage chest is provided. The example storage chest may include a box portion and a lid. The box portion may include a front wall, a rear wall, and a floor attached to the front and rear walls to form a primary compartment for storage of items. The lid may include a front panel, a rear panel, and a top panel attached to the front a rear panels. The rear panel may be pivotably coupled to the rear wall of the box portion. The front panel, the rear panel, and the top panel may define a secondary compartment within the lid for storage of items. The secondary compartment may comprise a bolster that provides structural support to the lid and a lid storage compartment. A wall of the lid storage compartment may be formed by the bolster.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 19A:
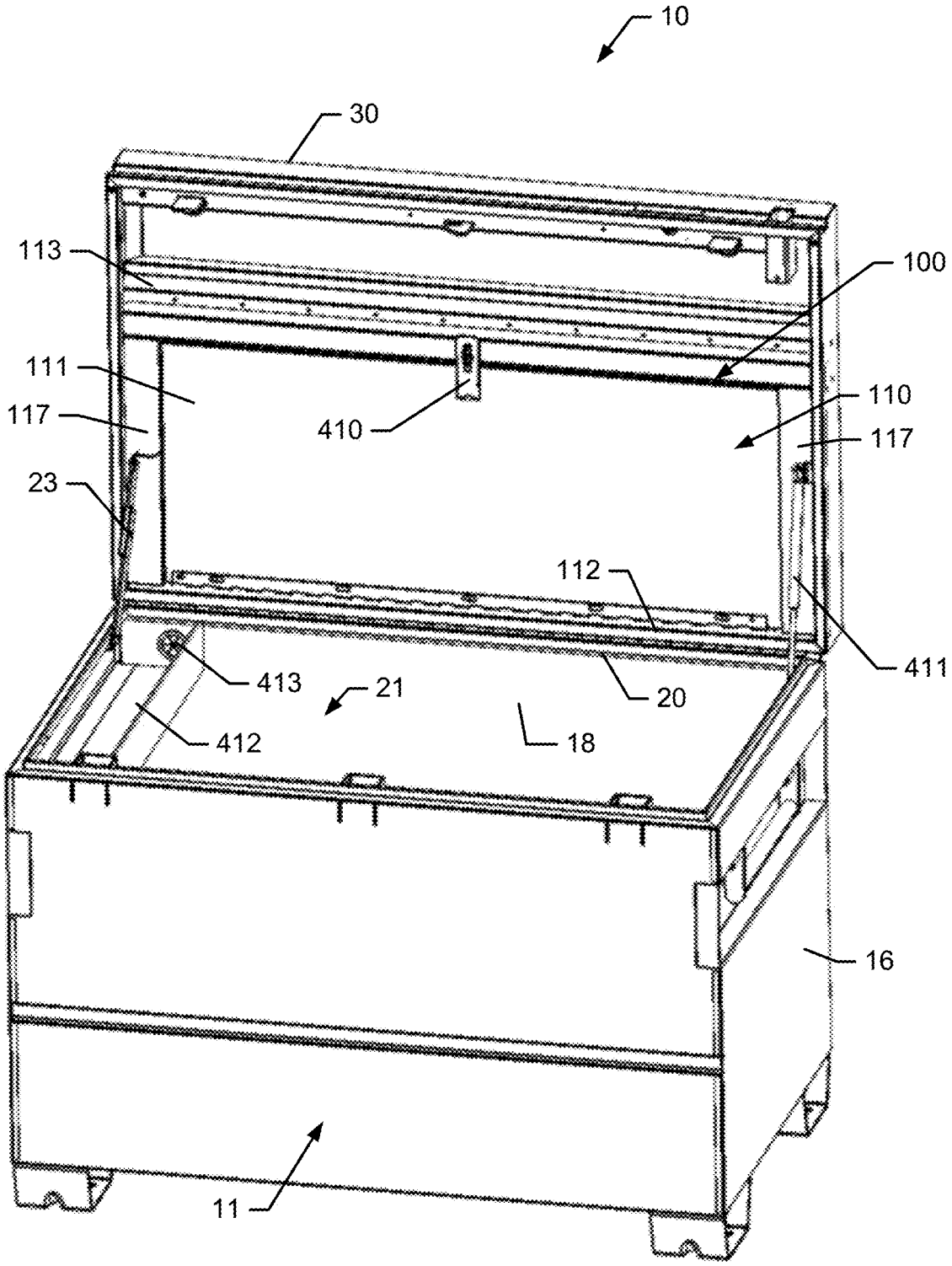
FIGS. 19A to 19C illustrate perspective view of another chest with a lid storage compartment in accordance with an example embodiment.
Figure 22A:
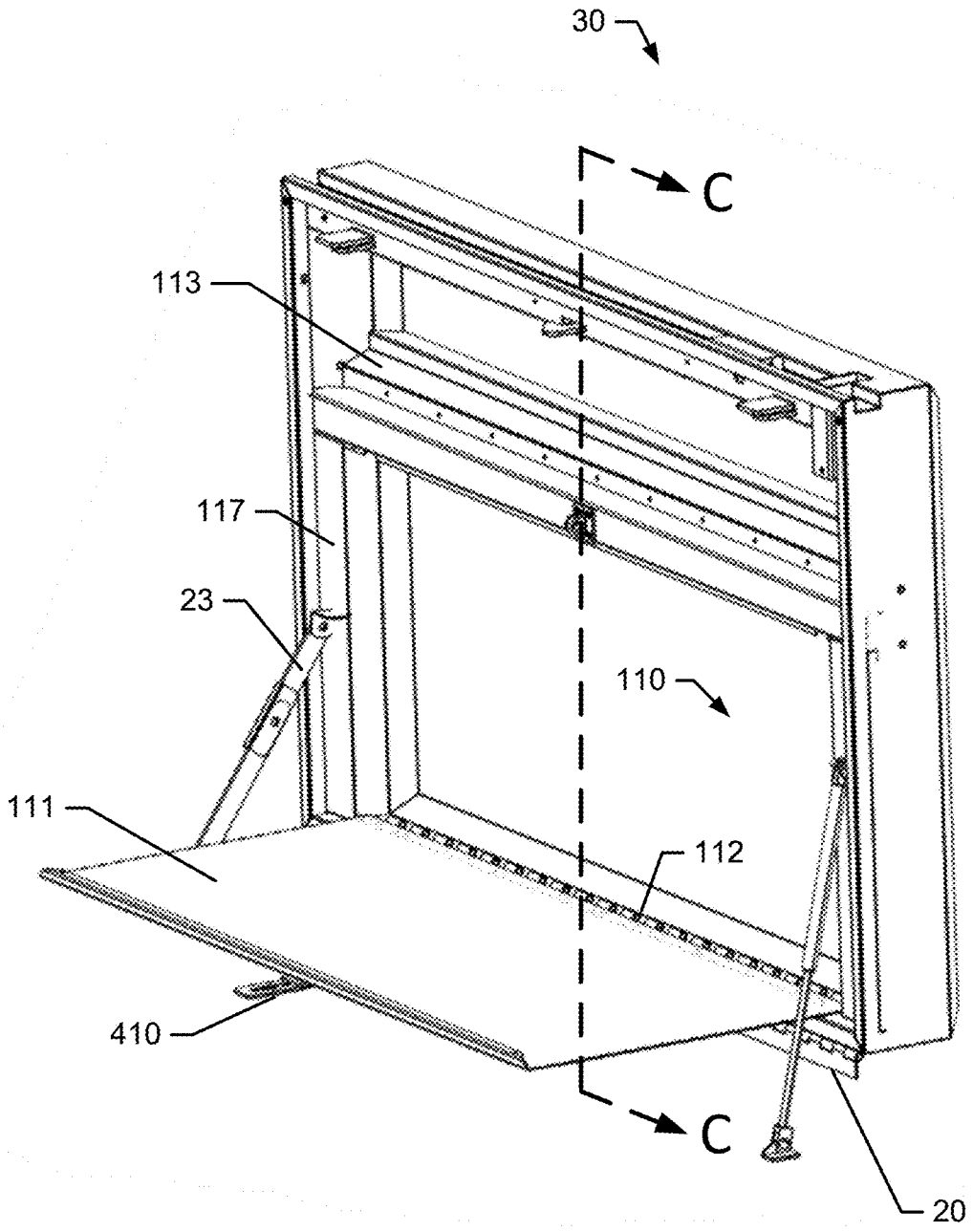
Figure 22B:
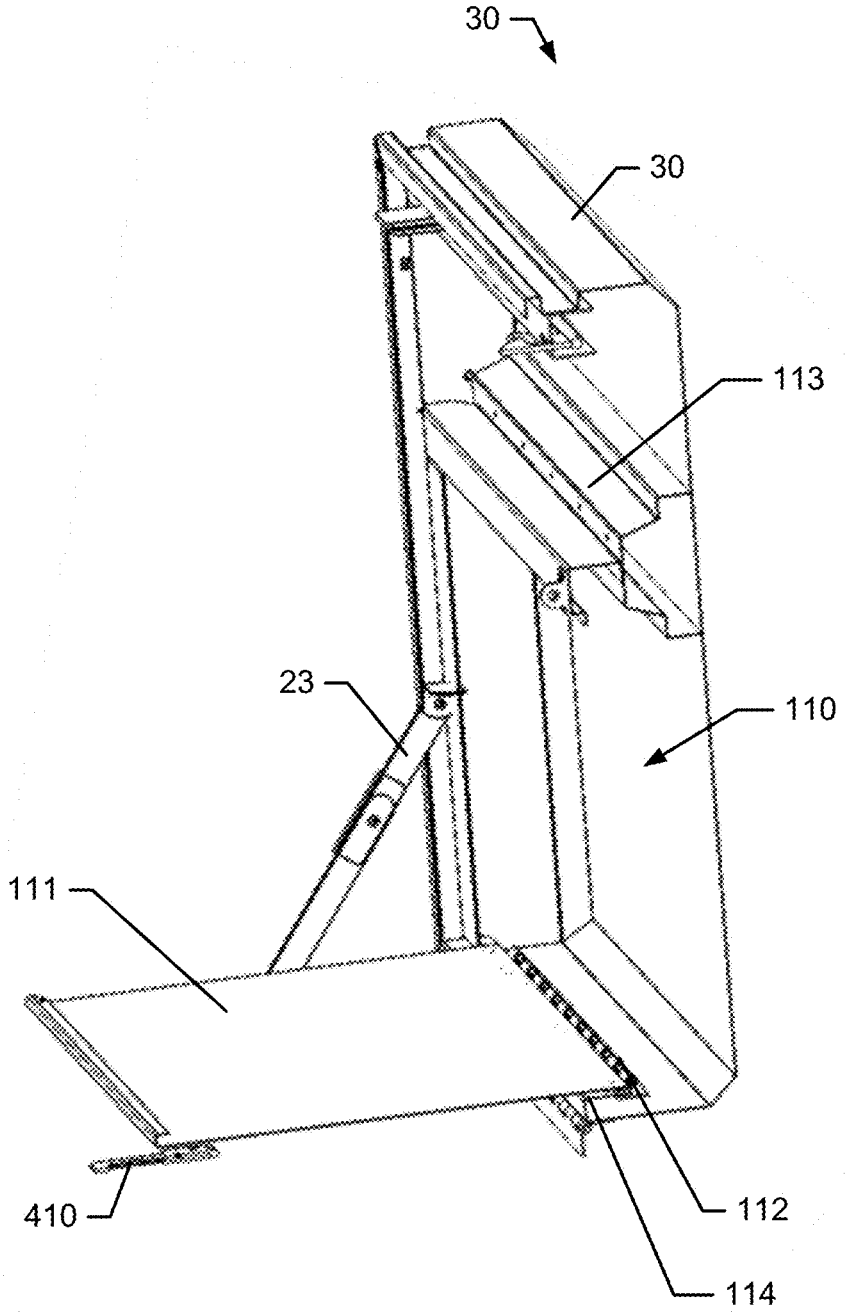

FIG. 22A illustrates a perspective view of the lid of the chest of FIG. 19A with the door for the lid storage compartment in an open position in accordance with an example embodiment; and FIG. 22B illustrates a perspective cross-section view of the lid of the chest of FIG. 19A taken at C-C of FIG. 22A with the door for the lid storage compartment in an open position in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

In view of the foregoing, according to some example embodiments, a storage chest is provided that includes a box portion defining a primary compartment and a lid pivotally attached to a lower box portion, where the lid includes a secondary compartment disposed therein. In this regard, the lid may have side panels and a top panel that together define a lid volume. The lid volume, or a portion thereof, may define the secondary compartment. According to some example embodiments, the secondary compartment may have compartment side panels where, according to some example embodiments, at least one of the side panels of the lid also operates as side panel for the secondary compartment. Further, the secondary compartment may house a variety of storage features that may be disposed and integrated into the secondary compartment. For example, the secondary compartment may include an enclosed lid storage compartment. The lid storage compartment may include a door that is hingedly attached to allow the door to swivel between an open and closed position while the lid of the chest is in the open position. According to some example embodiments, the door may be solid or the door may include a mesh or interlaced pattern to permit a worker to see into the lid storage compartment, even when the door is closed. Additionally or alternatively, the secondary compartment may include a bolster that provides structural support to the lid and also includes openings configured to receive a portion of a tool for storage of the tool in the secondary compartment. According to some example embodiments, a surface of the bolster may form an upper wall of the lid storage compartment of the secondary compartment.

The secondary compartment in the lid may be leveraged to store smaller items that may be more readily lost or difficult to find in the larger primary compartment of the box portion. Additionally, the secondary compartment may include a lockable portion (e.g., the lid storage compartment may be lockable) and thus the secondary compartment may be able to store items that are more likely to be stolen. The addition of the secondary compartment in the lid of the chest can operate to improve the organization within the storage chest by permitting items to be separated between the primary and secondary compartments. As such, items, including smaller items, that are stored in the secondary compartment of the lid may be secured and also more quickly located thereby avoiding the loss of work time that can result from a disorganized storage chest.

Figure 1A:
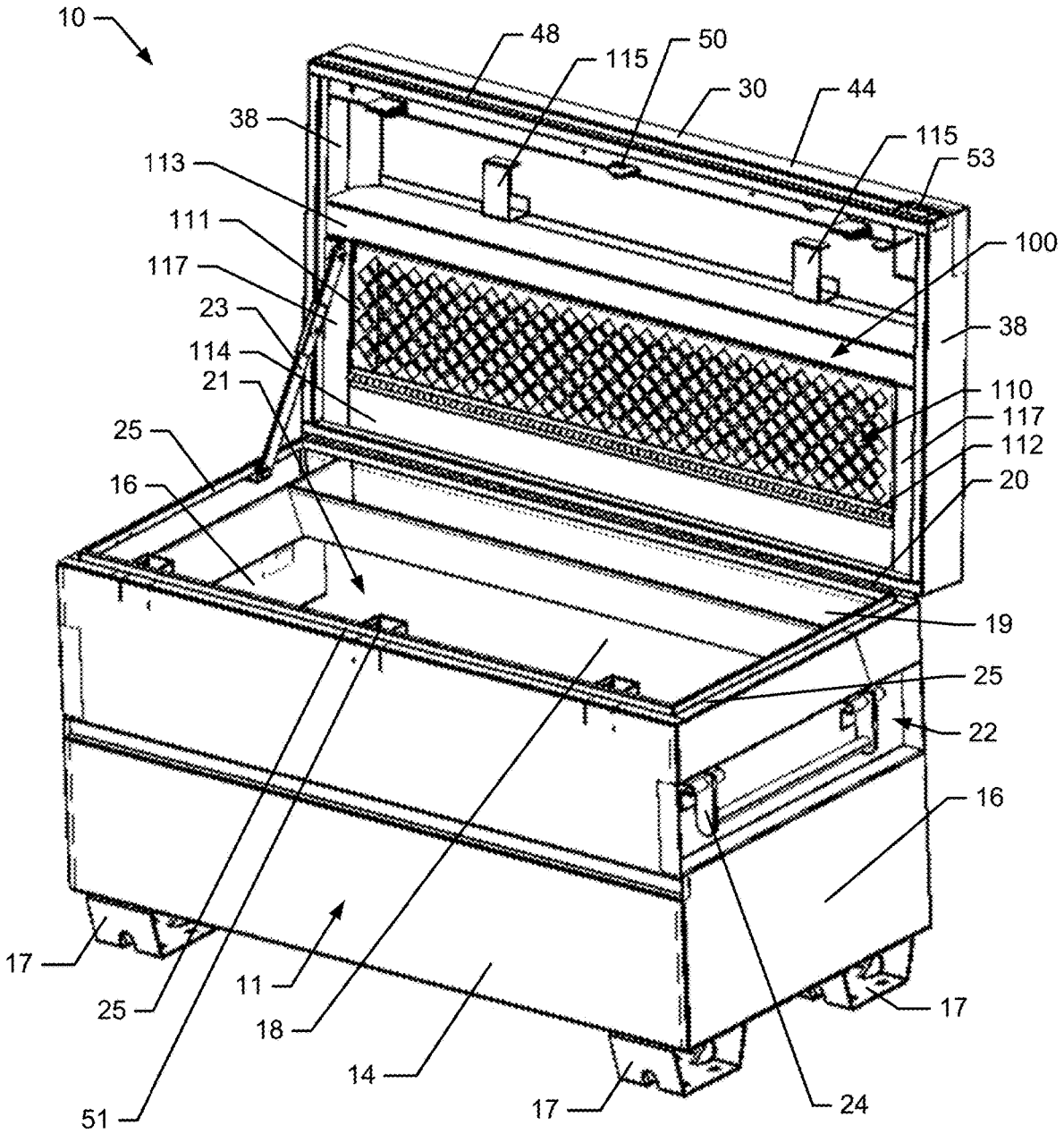
FIG. 1A illustrates a perspective view of a chest with a lid in an open position in accordance with an example embodiment.
Figure 1B:
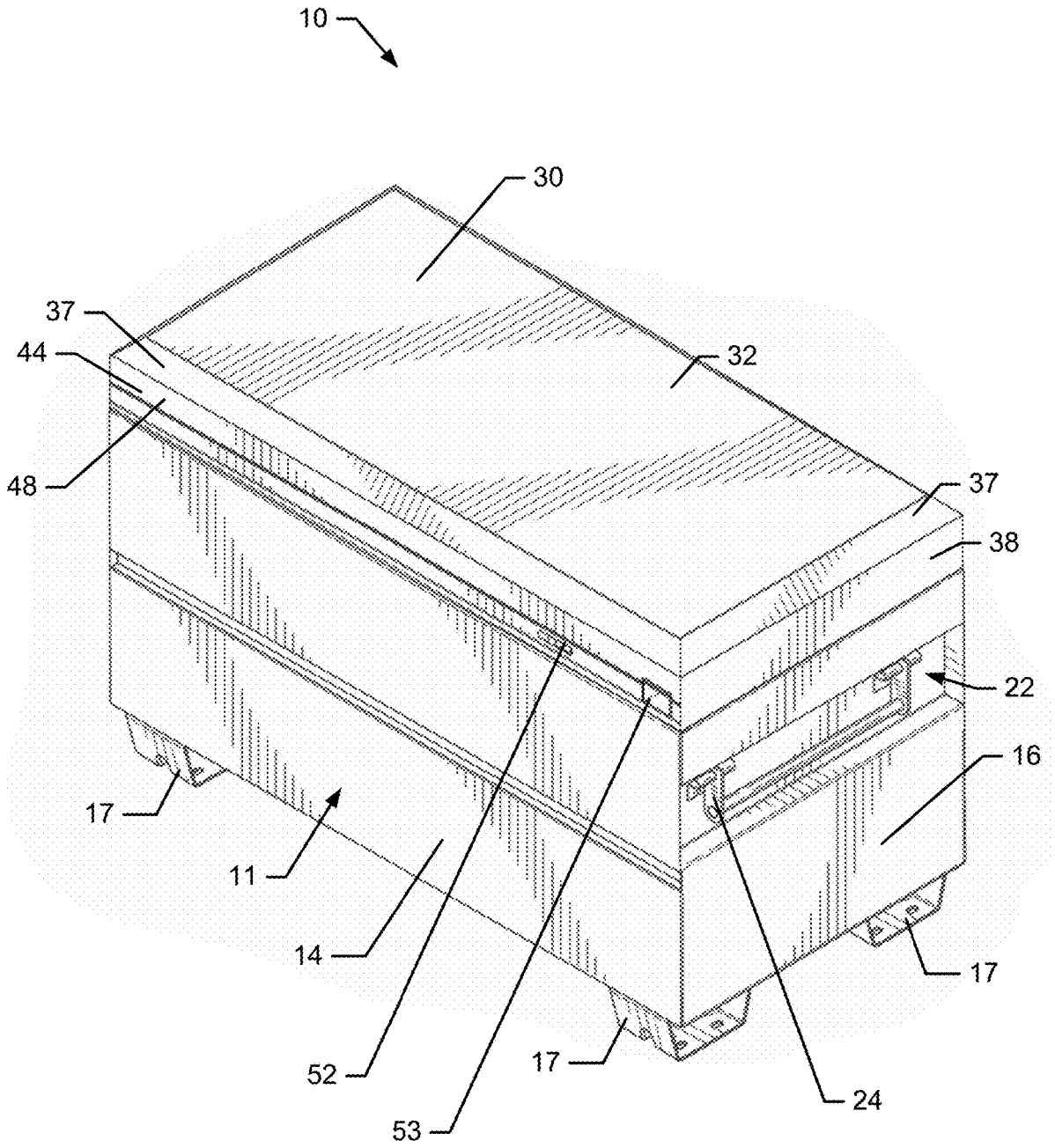
FIG. 1B illustrates a perspective view of the chest of FIG. 1 with the lid in a closed position in accordance with an example embodiment.
Figure 2:
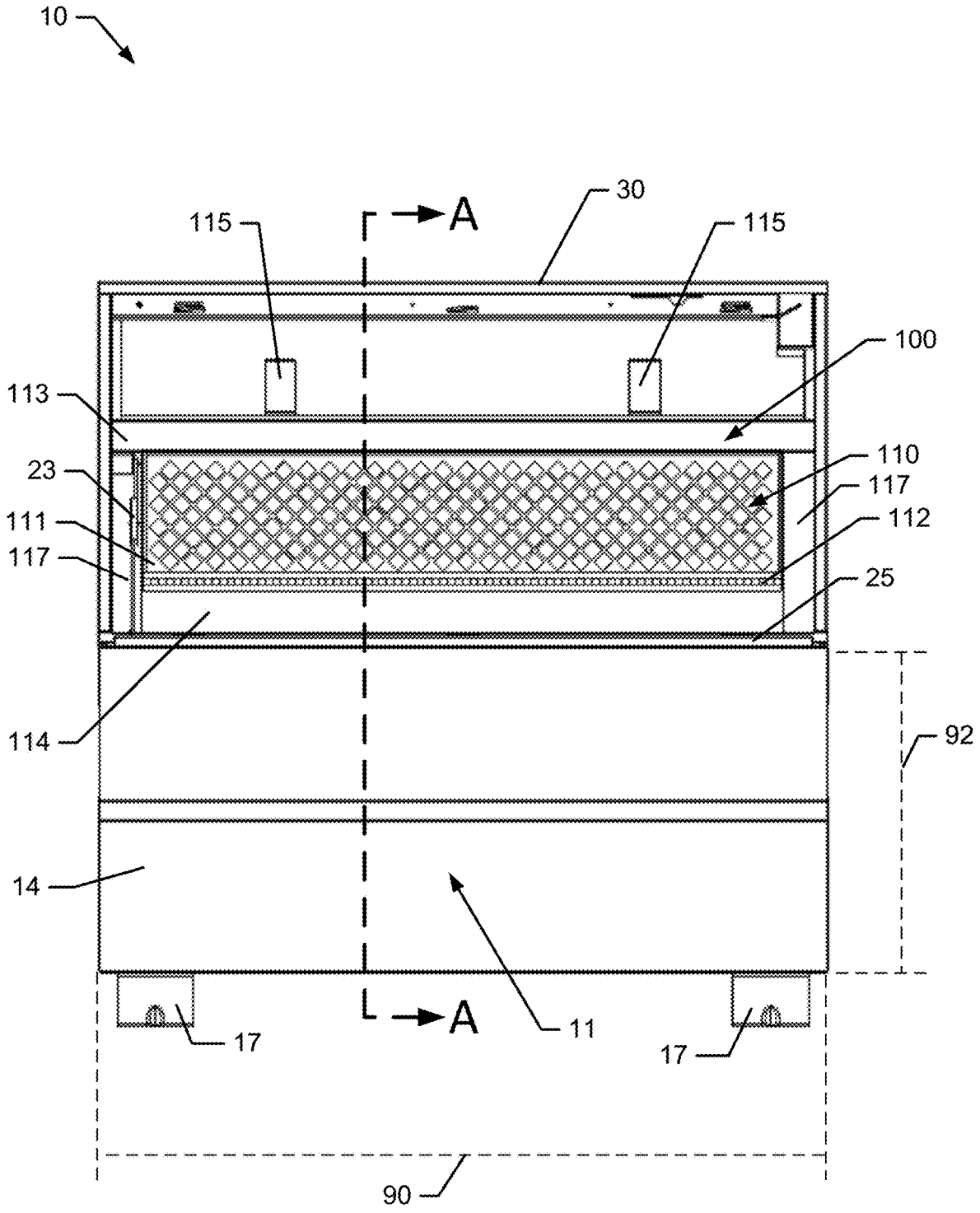
FIG. 2 illustrates a front view of a chest of FIG. 1 with the lid in an open position in accordance with an example embodiment.
Figure 3:
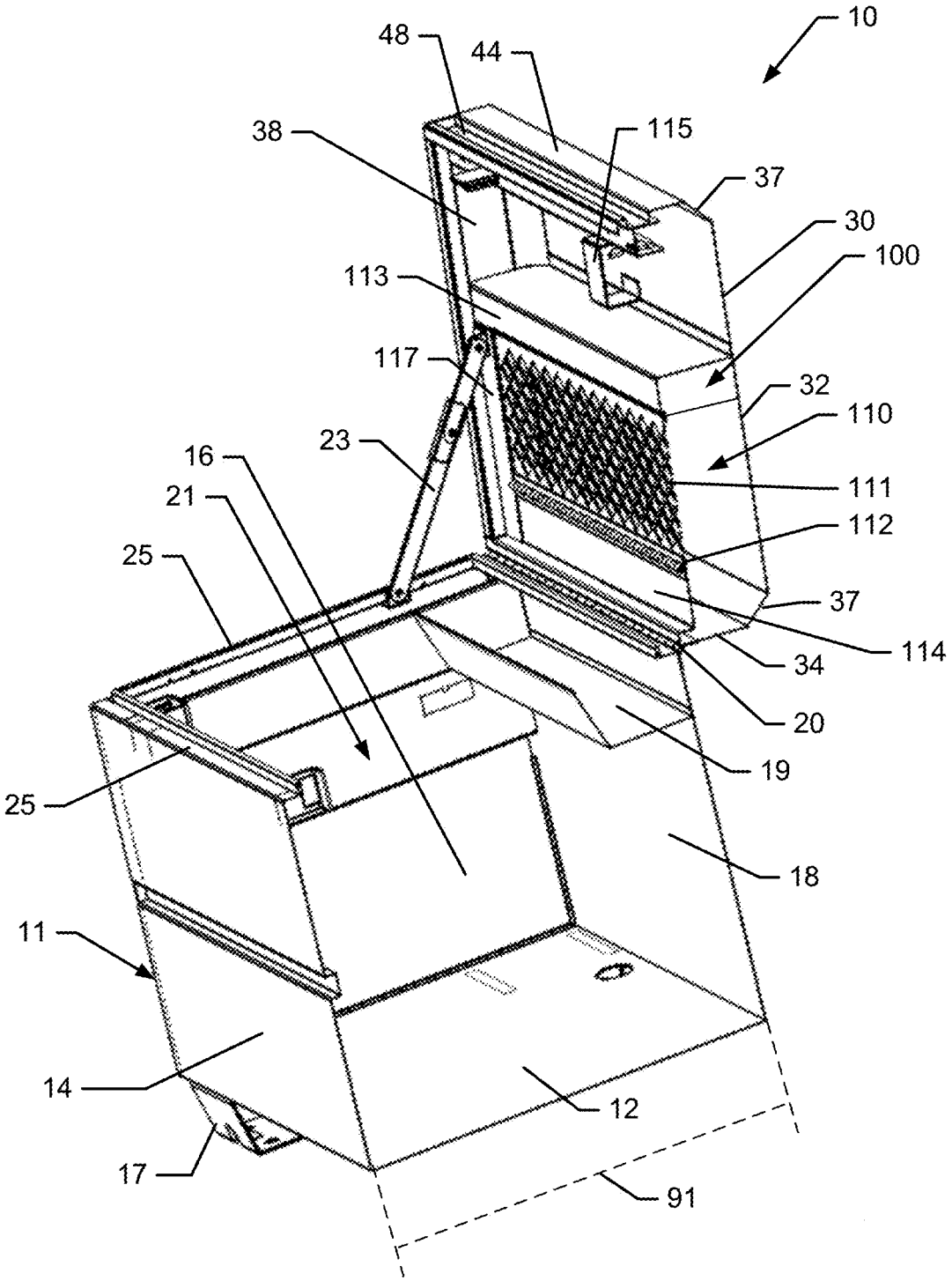
FIG. 3 illustrates a perspective cross-section view of the chest of FIG. 1 taken at A-A of FIG. 2 with the lid in an open position in accordance with an example embodiment.
Figure 4:
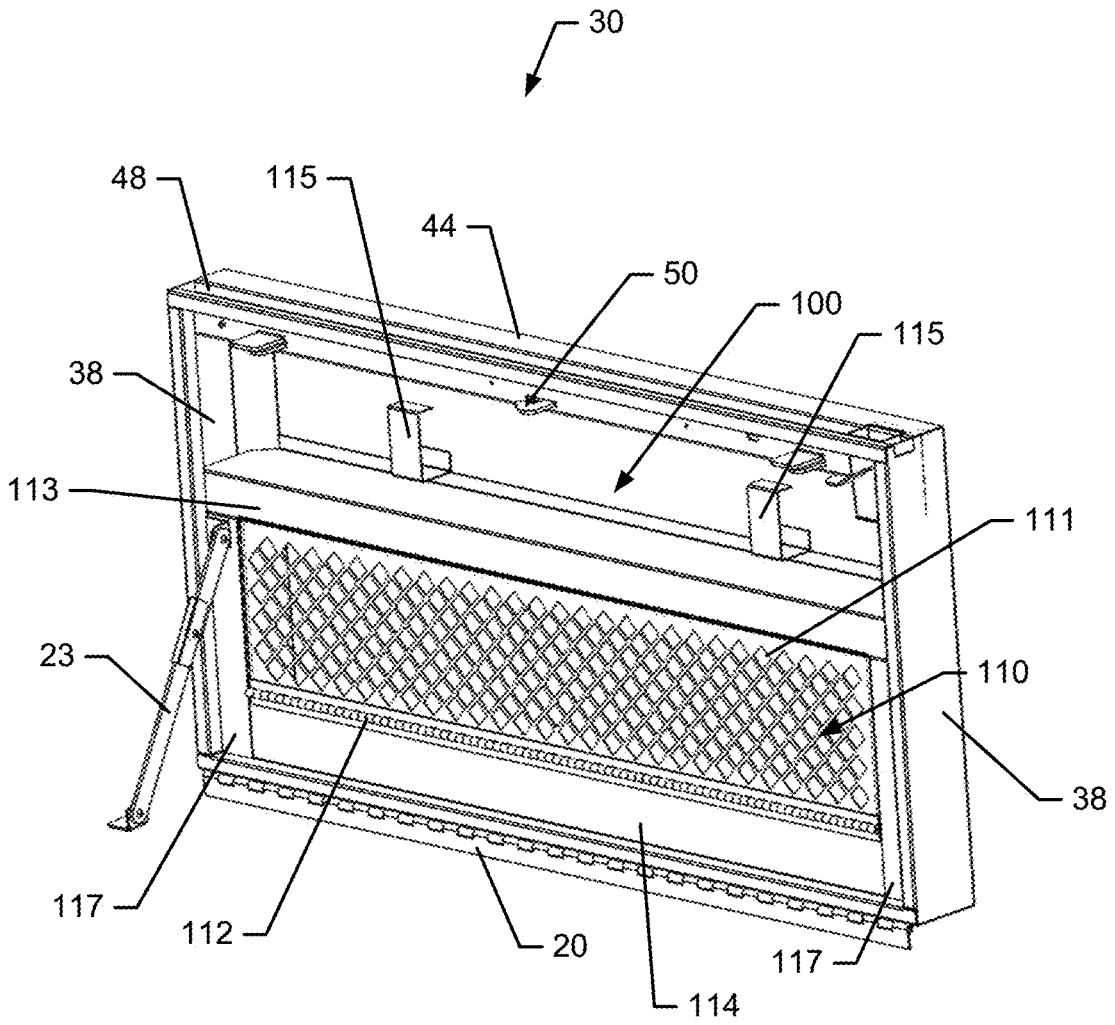
FIG. 4 illustrates a perspective view of the lid of the chest of FIG. 1 in accordance with an example embodiment.
Figure 5:
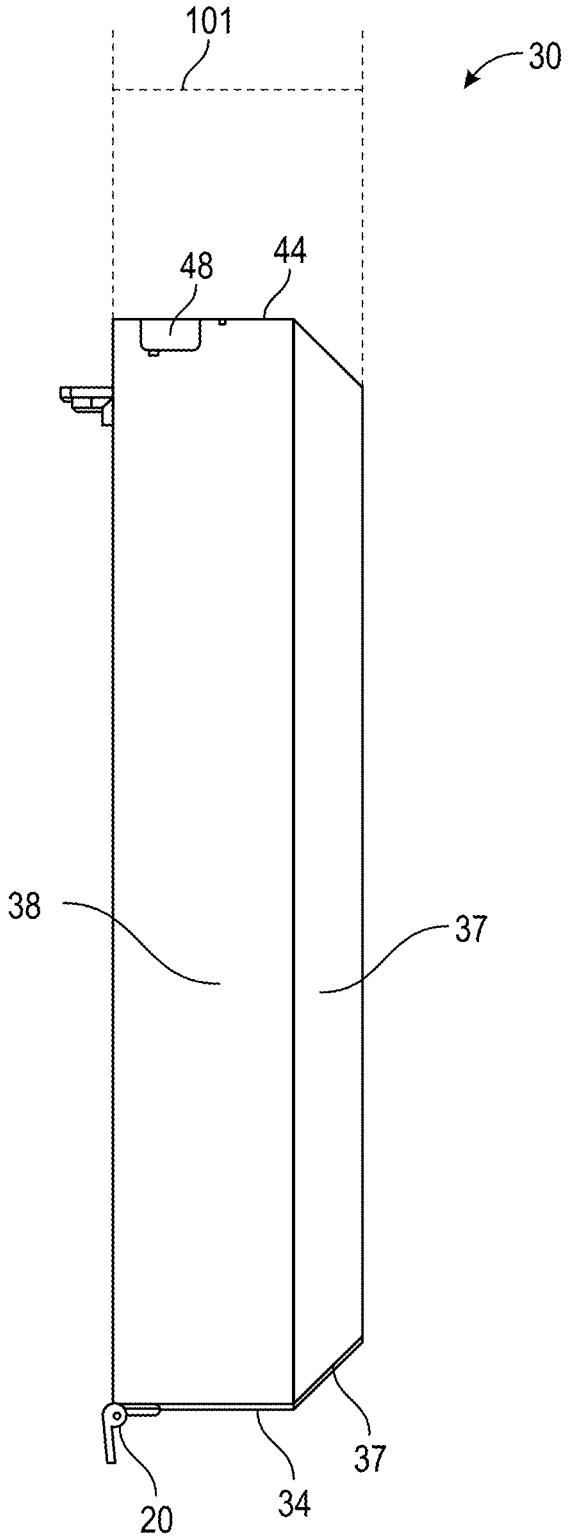
FIG. 5 illustrates a side view of the lid of the chest of FIG. 1 in accordance with an example embodiment.

Referring now to the drawings, an example storage chest designated broadly at 10 is illustrated in FIGS. 1A through 5, in which, FIG. 1A is a perspective view of an example chest 10 with a lid 30 in an open position; FIG. 1B is a perspective view of the example chest 10 with the lid 30 in a closed position; FIG. 2. is a front view of the chest 10; FIG. 3 is a cross-section perspective side view of the chest 10 with the cross-section taken at the plane A-A of FIG. 2; FIG. 4 is a perspective view of the lid 30; and FIG. 5 is a side view of the lid 30.

Accordingly, the chest 10 may include a box portion 11 and a lid 30 pivotally attached to the box portion 11 via hinge 20. The lid 30 may be movable between a closed position (FIG. 1B) in which the interior of the chest 10 cannot be accessed, and an open position (FIGS. 1A, 2, and 3) in which the interior of the chest 10 may be accessed.

The box portion 11 may include a floor 12, a front wall 14, two opposed sidewalls 16, and a rear wall 18. The floor 12, front wall 14, sidewalls 16, and rear wall 18 may define an internal cavity or compartment, i.e., primary compartment 21, within which tools or other items can be stored. Organization features may be included within the primary compartment 21, such as the tray 19 disposed on the rear wall 18 between the sidewalls 16. The sidewalls 16 may include recesses 22 in which carrying handles 24 may be pivotally mounted. The front wall 14, the side walls 16, and the rear wall 18 may include a lip 25 on each of the upper edges. The floor 12, front wall 14, sidewalls 16, and rear wall 18 of the box portion 11 may be formed of sheet steel or sheet aluminum having a thickness of, for example, between about 0.0299 and 0.1875 inches or about 0.025 and 0.2 inches.

The primary compartment 21 may be defined by a length 90, a width 91, and a depth 92. Based on the length 90, width 91, and depth 92, a volume of the primary compartment 21 may be defined. In this regard, according to some example embodiments, the length 90 may be about 48 inches, the width 91 may be about 30 inches, and the depth 92 may be about 33.375 inches, which may define the volume of the primary compartment 21 as about 27.8125 cubic feet. As such, according to various example embodiments, having different dimensions, the volume of the primary compartment 21 may be in the range of 20 to 40 cubic feet, 20 to 30 cubic feet, 30 to 40 cubic feet, or the like. Those skilled in this art will recognize that the rectangular shape of the box portion 11 illustrated herein is merely one configuration and that other configurations, such as one in which the box portion 11 has a square footprint or a rectangular footprint of different dimensions, can also be used. According to some example embodiments, another configuration may be a slope lid chest that has a lid that is hinged at its rear edge and slopes downwardly and forwardly toward the front wall of the chest. The lid of such a slope lid chest, according to some example embodiments, may be deposed on a plane that is not substantially parallel with the floor of the chest.

Additionally, a plurality of feet 17 may be attached to an external, bottom side of the floor 12. The feet 17 may operate to support and raise the box portion 11 off of the ground. By providing a space between the floor 12 and the ground, for example, the feet 17 may permit a forklift to be able to slide beneath the floor 12 to permit raising the chest 10 for movement to another location or onto a transportation vehicle. The feet 17 may be attached to the floor 12 by, for example, welding or fasteners. Each foot 17 may be formed of steel shaped into a U-shape for affixing to the bottom side of the floor 12.

The lid 30 may be pivotally attached to an upper edge of the rear wall 18 via the hinge 20. Hinge 20 may be a single hinge that spans a length of the rear wall 18 or, according to some example embodiments, the hinge 20 may include a series of separate hinges (e.g., two or three hinges) disposed along the upper edge of the rear wall 18. Additionally, according to some example embodiments, the lid 30 may be attached to the box portion 11 via one or more support bars 23. The support bar 23 may be comprised of two segments that rotatably couple at a support bar hinge. The support bar 23 may be affixed to a box portion 11, for example, via a sidewall 16 and affixed to the lid 30 via, for example, a compartment side panel 117 of the lid storage compartment 110 (as further described below). The compartment side panel 117 may be a forward facing member and affixed to a side panel 38 of the lid 30. The support bar 23 may be collapsible due to relative rotation of the segments to permit the lid 30 to move into the closed position. However, when the segments of the support bar 23 are in a linear alignment and engaged with a stop member, the support bar 23 may operate to support the weight of the lid 30 (and the lid 30 contents) and prevent the lid 30 from unintentionally moving into the closed position. Additionally, when the segments of the support bar 23 are in the linear alignment and engaged with the stop member, the support bar 23 may also operate to prevent the lid 30 from swiveling further backwards (e.g., beyond a desired position, such as 90 degrees or 100 degrees relative to the box portion 11).

The lid 30 may include a top panel 32, a rear panel 34, a pair of opposed side panels 38, and a front panel 44. According to some example embodiments, each of the rear panel 34, the side panels 38, and the front panel 44 may extend away from a respective edge of the top panel 32 in a downward direction (e.g., in a direction perpendicular to the top panel 32) when the lid 30 is oriented to face downward, such as when the lid 30 is in the closed position. According to some example embodiments, the lid 30 may include beveled edges 37 that are disposed about the perimeter of the top panel 32. In this regard, the beveled edges 37 may be oriented with the top panel 32 at an angle greater than 90 degrees (e.g., 135 degrees).

According to some example embodiments, the front panel 44 may include a recess 48 that is configured to provide a grasping location for the lid 30. The presence of the recess 48 in the front panel 44 of the lid 30 may provide the grasping location to facilitate a user moving the lid 30 between the open and closed positions. Thus, the lid 30 may be movable (e.g., swivel) between the closed position of FIG. 1B, in which the top panel 32 is disposed above and substantially parallel to the floor 12 and covers the box portion 11, and the open position, in which the top panel 32 is pivoted about the hinge 20 to a non-horizontal position (e.g., at or beyond 90 degrees) and the front panel 44 is positioned rearwardly on the front wall 14. In this regard, when the lid 30 is in the closed position, access to the interior of the chest 10 is denied, and when the lid 30 is in the open position, the interior of the chest 10 is accessible.

The chest 10 may also include a locking mechanism that operates to lock the lid 30 to the box portion 11. The locking mechanism may comprise one or more movable locking members 50 that are engageable and disengageable with respective lock receivers 51 to move between a locked position and an unlocked position, respectively, when the lid 30 is in the closed position. According to some example embodiments, the locking member 50 may be disposed on the lid 30 and the locking receiver 51 may be disposed on the box portion 11. In this regard, the movement of the locking member 50 may be controllable by a user via a switch 52. The switch 52 may be slideable sideways between a locked position where the locking member 50 is engaged with the receiving member 51, and an unlocked position where the locking member 50 is disengaged from the receiving member 51. The movement of the switch 52 may be restricted and prevented from moving out of the locked position by installation of a lock (e.g., a padlock) into the lock receptacle 53.

According to some example embodiments, the lid 30 may define a secondary compartment 100 disposed in the interior of the lid 30 that is inaccessible when the lid 30 is in the closed position. The secondary compartment 100 may, according to some example embodiments, be divided into different portion to provide a variety of different storage options beyond what is provided by the primary compartment 21. In this regard, according to some example embodiments, the volume of the secondary compartment 100 may be defined by the length 90 and the width 91 (since these dimensions may be shared with box portion 11) and the depth 101 of the lid 30. According to some example embodiments, beveled edges 37 may operate to reduce the volume of the secondary compartment 100, relative to a lid 30 that does not include the beveled edges 37. According to some example embodiments, the depth 101 may be 5.5 inches and thus a volume of the secondary compartment 100 may be about 3.5 cubic feet. According to various example embodiments, due to different dimensions of the chest 10 and the depth 101 of the lid 30, the volume of the secondary compartment 100 may range between, for example, 2.5 cubic feet and 5 cubic feet, but other volumes may also be used.

Further, according to some example embodiments, a ratio relationship between the volume of the primary compartment 21 and the secondary compartment 100 may be 10 to 1. Further, the ratio relationship of the volume of the primary compartment 21 to the volume of the secondary compartment 100 may defined by various ranges, including from 8:1 to 12:1, from 5:1 to 10:1, from 7:1 to 11:1 or the like. The same or similar ratios may be defined between the depth 92 of the box portion 11 and the depth 101 of the lid 30, since, according to some example embodiments, the length and width dimensions may be the same.

According to various example embodiments, a variety or storage features may be integrated into the secondary compartment 100 in the interior of the lid 30. The following provides some example storage features that may be integrated, individually or in combination, into the secondary compartment 100.

For example, the secondary compartment 100 may include an enclosed lid storage compartment 110. The lid storage compartment 110 may be enclosed, for example, by a door 111, a portion of the top panel 32, the front panel 44 or the rear panel 34, and a bolster 113. The door 111 may be configured to swivel, slide, or otherwise move between and open and closed position. According to some example embodiments, the door 111 may have a flat or planar rectangular shape. According to some example embodiments, a series of two or more doors may be included that operate in the same manner as door 111, but cover a smaller portion of the lid storage compartment 110 to compartments of the lid storage compartment 110. In this regard, the door 111 may be hingedly attached to the lid 30 via a hinge 112. As shown with respect to the example chest 10, the hinge 112 may be disposed near rear panel 34 of the lid 30, and therefore the door 111 may swivel down towards the box portion 11 in the open position and up towards the front panel 44 in the closed position. In this regard, the hinge 112 may be disposed in parallel with the hinge 20. According to some example embodiments, the door 111 may be solid or the door 111 may include a mesh or interlaced pattern to permit a worker to see into the lid storage compartment 110, even when the door 111 is closed. According to some example embodiments, the door 111 may comprise a transparent material, such as an acrylic material to provide visibility and security.

According to some example embodiments, the door 111 may define a portion of the front face of the lid storage compartment 110. In this regard, the front of the lid storage compartment 110 face (i.e., the surface facing the front wall 14 of the box portion 11 when the lid 30 is in the open position) may include a well panel 114. The well panel 114 may be affixed to the lid 30 (e.g., affixed to the rear panel 34) at a lower portion of the lid storage compartment 110 and the hinge 112 may be affixed to the well panel 114. In this regard, the well panel 114 may, according to some example embodiments, provide a surface upon which the hinge 112 may be affixed. Further, according to some example embodiments, the well panel 114 may provide the lid storage compartment 110 with a fixed depth when the door 111 is in the open position to prevent items stored within the lid storage compartment 110 from falling out, when the door is opened. According to some example embodiments, a lower edge of the well panel 114 may be affixed to the rear panel 34 of the lid 30.

As indicated above, one surface for enclosing the lid storage compartment 110 may be a wall of a bolster 113. In addition to providing a wall of the lid storage compartment, the bolster 113 may be configured to provide structural support to the lid 30 to, for example, prevent the lid 30 from bowing or buckling if force is applied to the top panel 32 of the lid 30. While some of the bolsters described herein may extend between the walls of the lid 30, some bolsters may not extend to the walls and may be primarily purposed for supporting tool or other item storage in the lid 30. In this regard, the lid 30 may include a bolster 113 in the interior of the lid 30 to provide increased structural support to the lid 30. In this regard, bolster 113 may be a rigid generally U-shaped member that is affixed (e.g., welded) to an interior surface of the top panel 32 of the lid 30. However, according some example embodiments, such as some further described below, the bolster 113 may take the form of an L-shaped brace or the like. The bolster 113 may extend across a length of the lid 30 (i.e., length 90) between the side panels 38, and the bolster 113 may be affixed (e.g., welded) to the side panels 38, as well as the top panel 32. According to some example embodiments, the bolster 113 may be located within a threshold distance of a center line of the lid 30 to provide structural support. According to some example embodiments, the door 111 may be configured to latch in the closed position to the bolster 113 via a mechanical or magnetic latch such that the door 111 is maintained in the closed position when, for example, the lid is moved into the lid closed position. For example, the door 111 and the bolster 113 may have a lock hasp affixed thereto to facilitate holding the door 111 in the closed position and locking the door 111 with, for example, a pad lock.

The lid storage compartment 110 may be configured to secure a variety of items that may be used at a work site. For example, power tools such as drills and the like may be secured within the lid storage compartment 110. Since items may be tossed or dropped in the primary compartment 21, the lid storage compartment 110 disposed within the secondary compartment 100, may offer storage for more sensitive tools that could be damaged if placed in the primary compartment 21 of the box portion 11.

According to some example embodiments, a second portion of the secondary compartment 100 (e.g., the space above the bolster 113) may be configured for use as a storage feature within the chest 10. As such, another portion of the secondary compartment 100 may include, for example, hooks 115. The hooks 115 may be affixed to the top panel 32 (possibly above the bolster 113). The hooks 115 may be formed, for example, in the shape of a "C" to hold longer items within the secondary compartment 100. In this regard, according to some example embodiments, each hook 115 may have a first portion that is affixed to the top panel 32, a second portion (e.g., disposed at about 90 degrees to the first portion) that forms a base of the hook when the lid 30 is open that may or may not be affixed to the bolster 113, a third portion that forms a front wall of the hook 115 facing forward (e.g., disposed at about 90 degrees to the second portion), and a top lip of the hook to hold items within the hooks, particularly when the lid is closed or transitioning between the closed or open position. The top lip may be disposed at a 90-degree angle to the third, forward facing portion. However, the top lip, according to some example embodiments, does not extend to the top panel 32 to allow for removal of an item via the gap between the top panel 32 and the top lip of the hook 115. According to some example embodiments, longer items may be stored in the hooks 115 such as, for example, a level, yard stick, a straight edge, long drill bits, or the like.

Figure 6A:
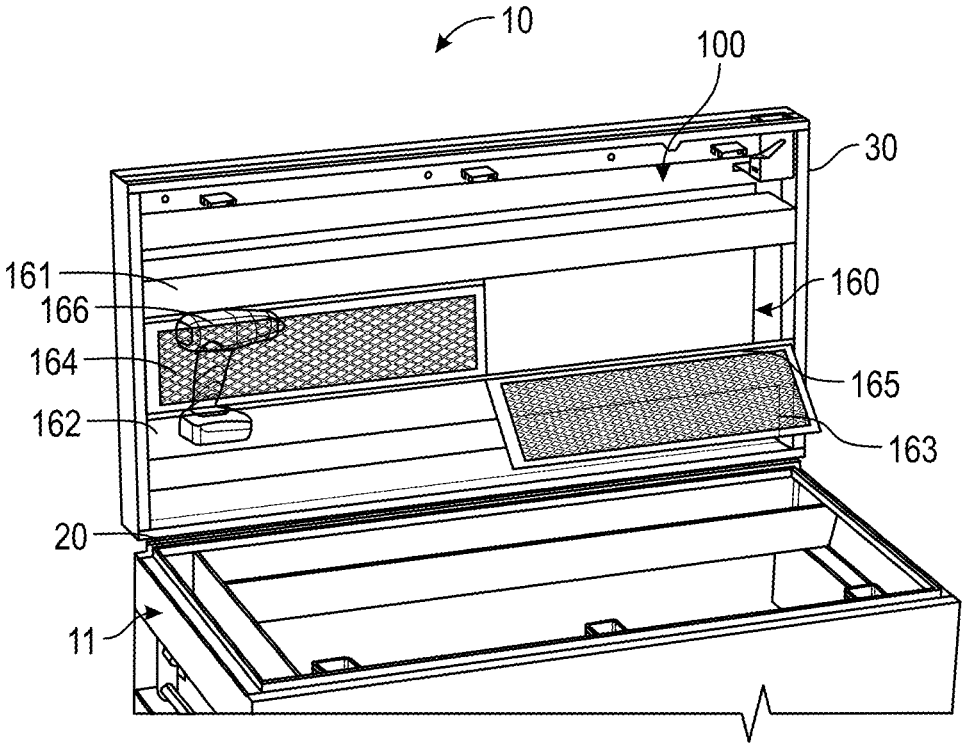
FIG. 6A illustrates a partial perspective view of a chest with a lid storage compartment in accordance with an example embodiment.
Figure 6B:
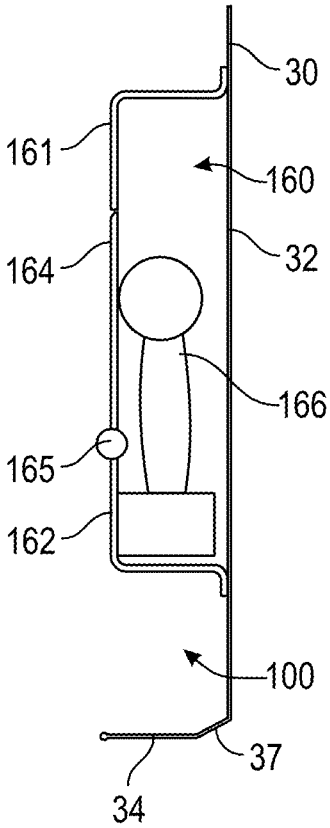
FIG. 6B illustrates a side cross-section view of a lid of a chest with a lid storage compartment in accordance with an example embodiment.

Another example storage feature that may be disposed in the secondary compartment 100 in the lid 30 is shown in FIGS. 6A and 6B. FIG. 6A provides a perspective partial view of a variation of the chest 10 with a lid 30, and FIG. 6B provides a cross-section side view of a lid storage compartment 160 within a secondary compartment 100. In this regard, another example lid storage compartment 160 is provided. For the lid storage compartment 160, the upper wall may be defined by an upper bolster 161 and the lower wall may be defined by the lower bolster 162. The side walls of the lid storage compartment 160 may be defined by the side panels of the lid 30. The upper bolster 161 and the lower bolster 162 may be L-shaped. As such, the bolsters 161, 162 may form a cavity within which a tool, such as power drill 166 may be secured. The lid storage compartment 160 may also include doors 163 and 164 that are hingedly attached to the lower bolster 162 via a hinge 165. In this regard, the lower bolster 162 may operate similar to the well panel 114 described above. The doors 163, 164 may have a flat, planar rectangular shape. The hinge 165 may permit the doors 163, 164 to swivel (as indicated by the arrow in FIG. 6A) between an open position (e.g., swiveled downward) and a closed position (e.g., swiveled upward), when the lid 30 is in the open position. The hinge 165 may be disposed to be in parallel with the lid hinge 20. The doors 163, 164 may be configured to mechanically or magnetically latch into the closed position. Similar to the door 111, the doors 163, 164 may have a mesh pattern to permit a user to see into the lid storage compartment 160 to locate an item.

Figure 7A:
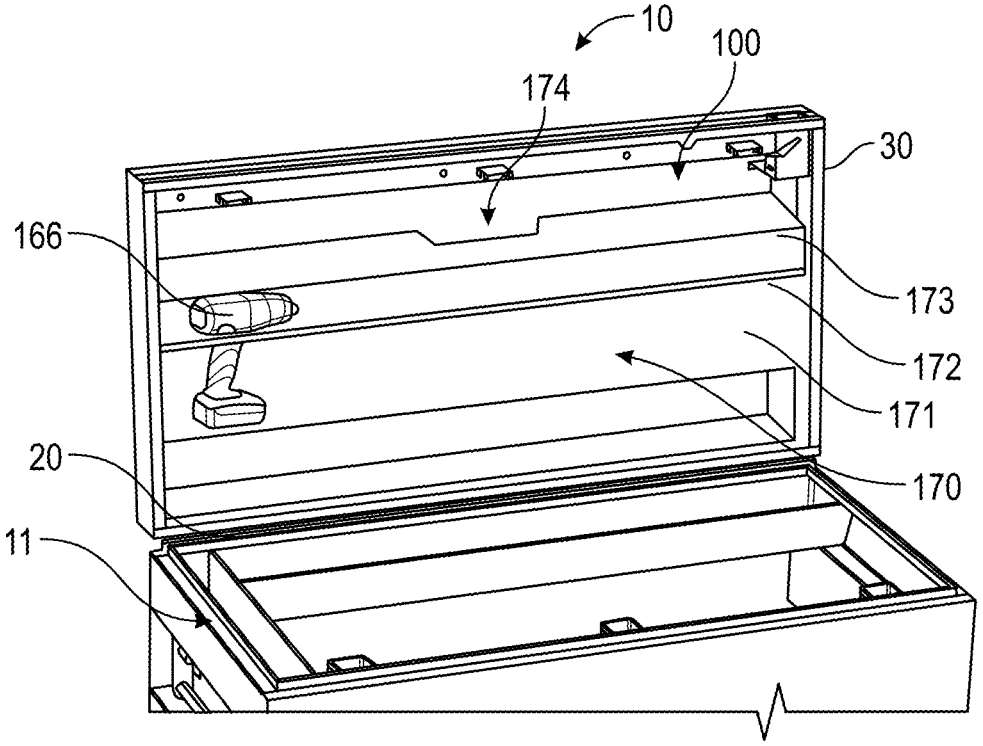
FIG. 7A illustrates a partial perspective view of a chest with a lid storage compartment having a closed door in accordance with an example embodiment.
Figure 7B:
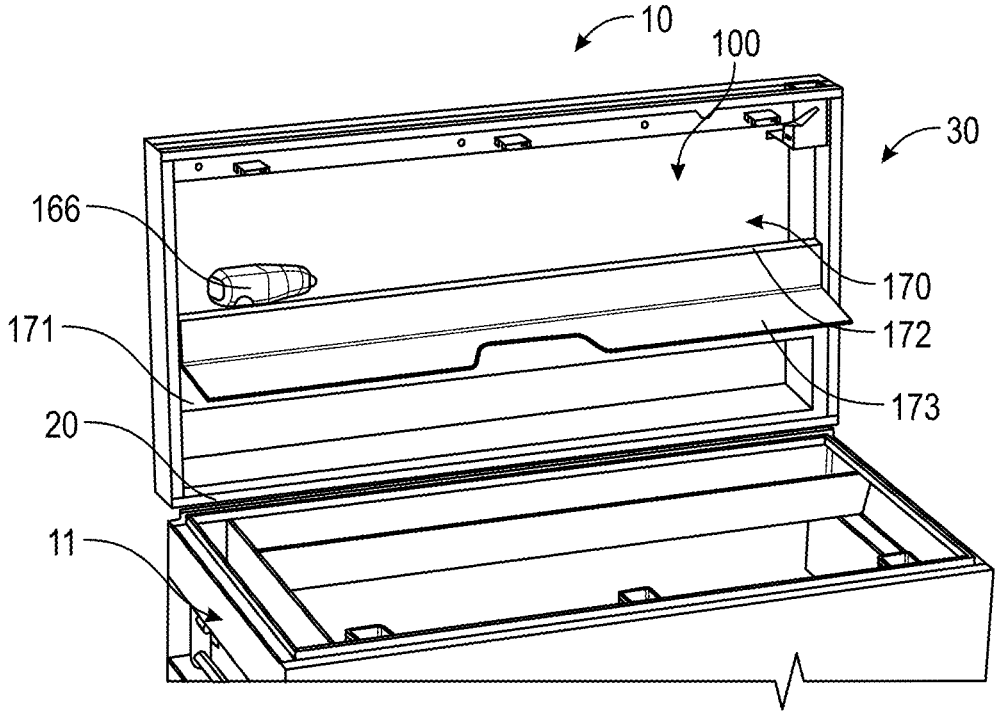
FIG. 7B illustrates a partial perspective view of a chest with a lid storage compartment having an open door in accordance with an example embodiment.
Figure 7C:
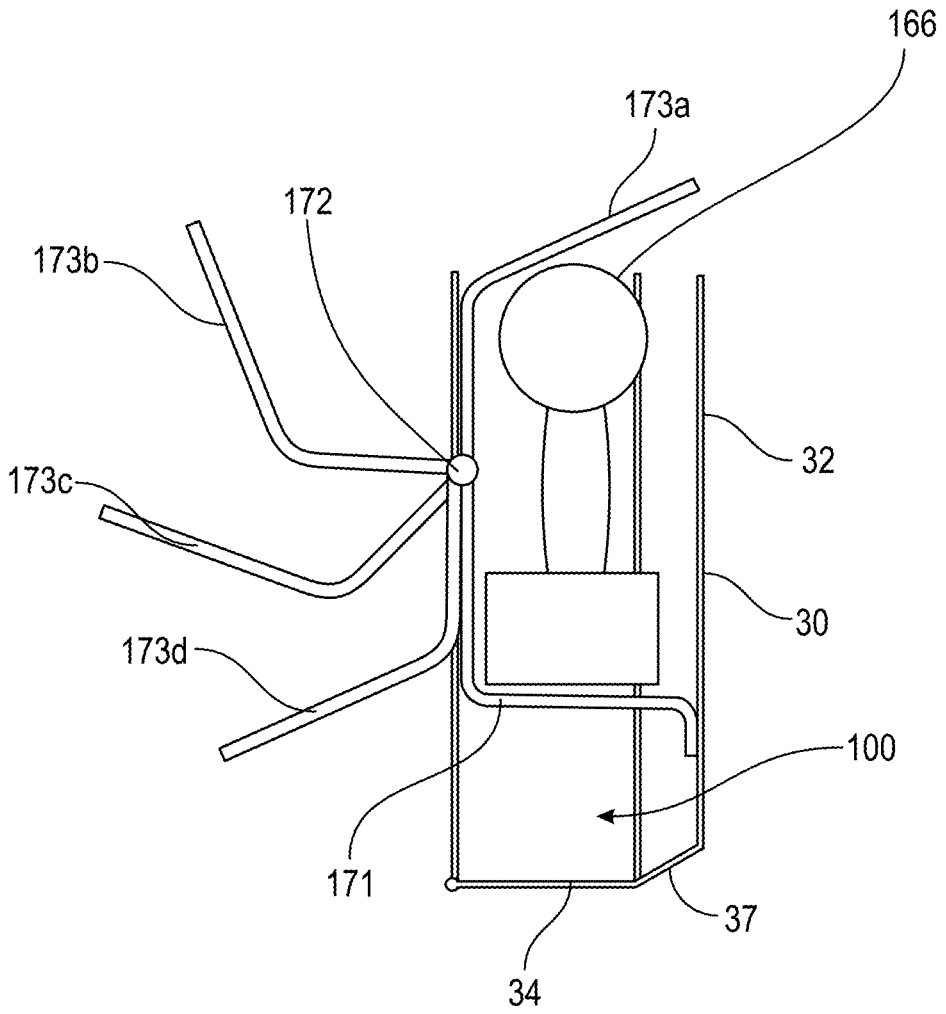
FIG. 7C illustrates a side cross-section view of a lid of a chest with a lid storage compartment in accordance with an example embodiment.

Another example storage feature that may be disposed in the secondary compartment 100 in the lid 30 is shown in FIGS. 7A to 7C. FIG. 7A provides a perspective partial view of a variation of the chest 10 with a lid 30, where a lid storage compartment 170 is closed, and FIG. 7B a perspective partial view of a variation of the chest 10 with a lid 30 where a lid storage compartment 170 is open. The lid storage compartment 170 includes a lower bolster 171 that has an L-shape. A hinge 172 may be affixed to the lower bolster 171 and a door 173 that permits the door 173 to swivel from a closed position (FIG. 7A) and an open position (FIG. 7B). The door 173 may include a bend (e.g., at an angle greater than 90 degrees) with the bent portion forming a top surface of the lid storage compartment 170. The lower bolster 171 and the door 173 may form the lid storage compartment 170 that tools (e.g., power tool 166) may be securely placed within. The door 173 may have a mechanical or magnetic latch and a cutout portion 174 that can operate as an opening handle. FIG. 7C shows a cross-section view of the lid storage compartment 170 and a portion of the lid 30 with the door 173 in various positions between being open and closed. In this regard, the door 173 may be in the closed position at 173*a* and may swivel, due to action at the hinge 172, sequentially, into positions 173*b* and 173*c*, before reaching the open position at 173*d*.

Figure 8:
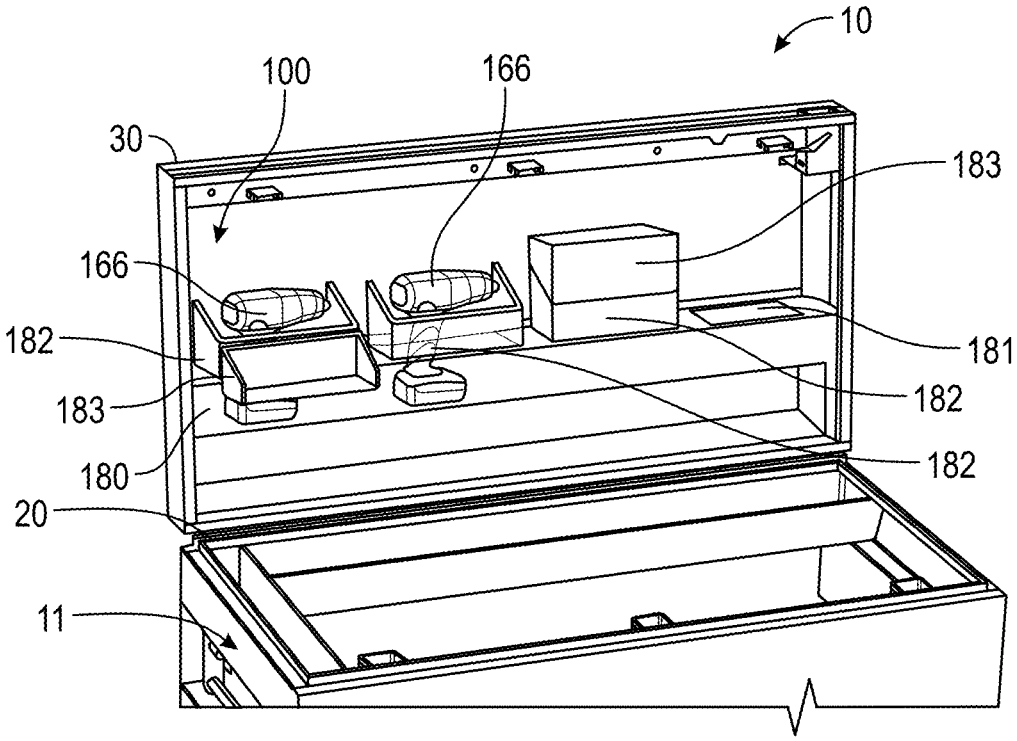
FIG. 8 illustrates a partial perspective view of a chest with a plurality of tool lid storage compartments in accordance with an example embodiment.

Another example storage feature that may be disposed in the secondary compartment 100 in the lid 30 is shown in FIG. 8. FIG. 8 provides a perspective partial view of a variation of the chest 10 with a lid 30 having a plurality of lid storage compartments. In this regard, each lid storage compartment may be designated to store a single tool (e.g., tool 166). The lid 30 may include a bolster 180 having openings 181 for receiving a base of a tool. Above the opening, a lower shell 182 may be affixed (e.g., welded) to the bolster 180. The lower shell 180 may have sides, for example, with angled edges that operate to provide increased access to a tool stored within the lid storage compartment when the door 183 is open. The door 183 may be hingedly affixed to the lower shell 182 along a front edge of the lower shell 182 to permit the door 183 to move between an open position and a closed position. In this regard, the door 183 may have angled sides that are complementary to the angled sides of the lower shell 182. The door 183 may have a mechanical or magnetic latch to maintain the door 183 in the closed position when, for example, the lid 30 is closed. According to some example embodiments, the lid storage compartment may omit the door and the power tool 166 may rest or be press fit into the opening 181.

Figure 9:
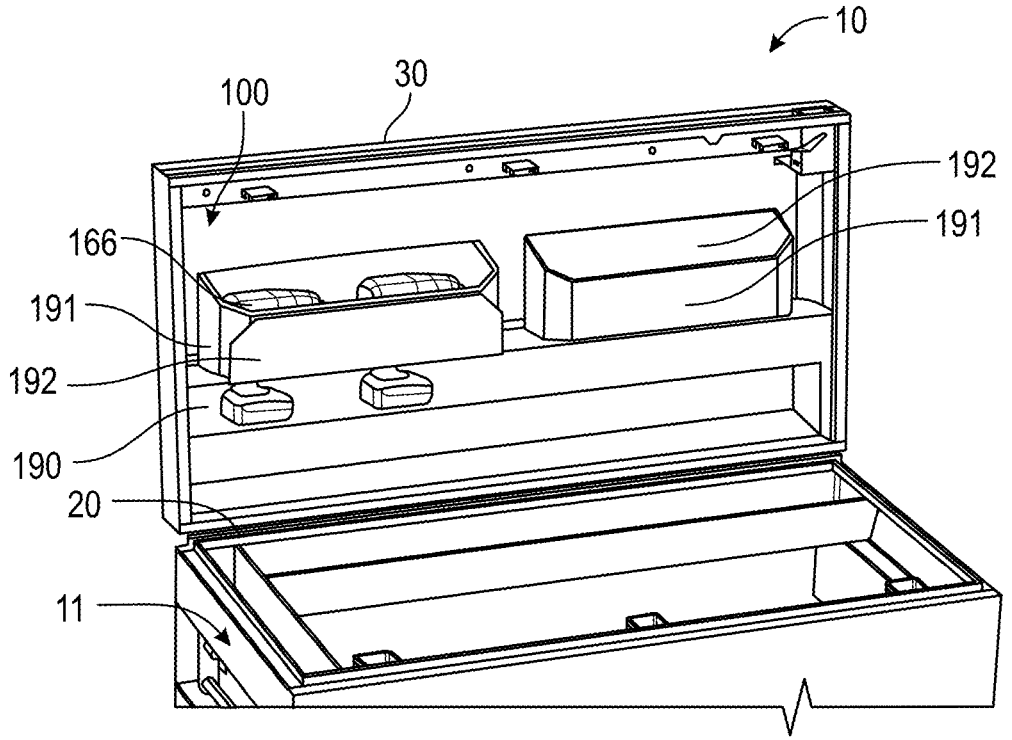
FIG. 9 illustrates a partial perspective view of a chest with a plurality of multi-tool lid storage compartments in accordance with an example embodiment.

Another example storage feature that may be disposed in the secondary compartment 100 in the lid 30 is shown in FIG. 9. FIG. 9 provides a perspective partial view of a variation of the chest 10 with a lid 30 with a plurality of lid storage compartments. In this regard, each lid storage compartment may be designated to store, for example, two tools (e.g., tool 166). In this regard, the lid 30 may include a bolster 190 having openings therein for receiving a base of a tool. Above the opening, a lower shell 191 may be affixed (e.g., welded) to the bolster 190. The lower shell 191 may have sides with angled edges that operate to provide increased access to the tools stored within the lid storage compartment when the door 192 is open. The door 192 may be hingedly affixed to the lower shell 191 along a front edge of the lower shell 191 to permit the door 192 to move between an open position and a closed position. In this regard, the door 192 may be a flat plate formed to fit in the opening defined by the lower shell 191. The door 192 may have a mechanical or magnetic latch to maintain the door 192 in the closed position when the lid 30 is closed.

Figure 10:
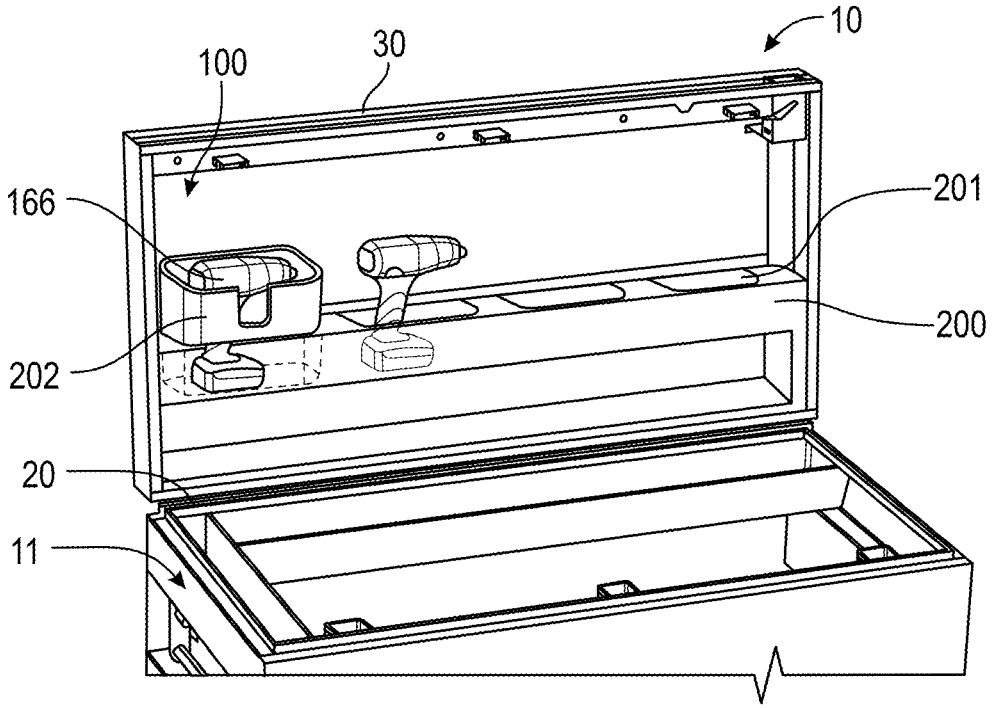
FIG. 10 illustrates a partial perspective view of an example chest with a plurality of single tool lid storage compartments, one of which having a tub in accordance with an example embodiment.

Another example storage feature that may be disposed in the secondary compartment 100 in the lid 30 is shown in FIG. 10. FIG. 10 provides a perspective partial view of a variation of the chest 10 with a lid 30 with a plurality of lid storage compartments. In this regard, each lid storage compartment may be designated to store, for example, a single tool (e.g., tool 166). The lid 30 may include a bolster 200 having openings 201 therein. A plastic tub 202 may be press fit into the opening 201 and configured to receive the base of a tool 166 within the tub 202. The tub 202 may also include a cutout portion that operates to provide additional access to the tool 166.

Figure 11A:
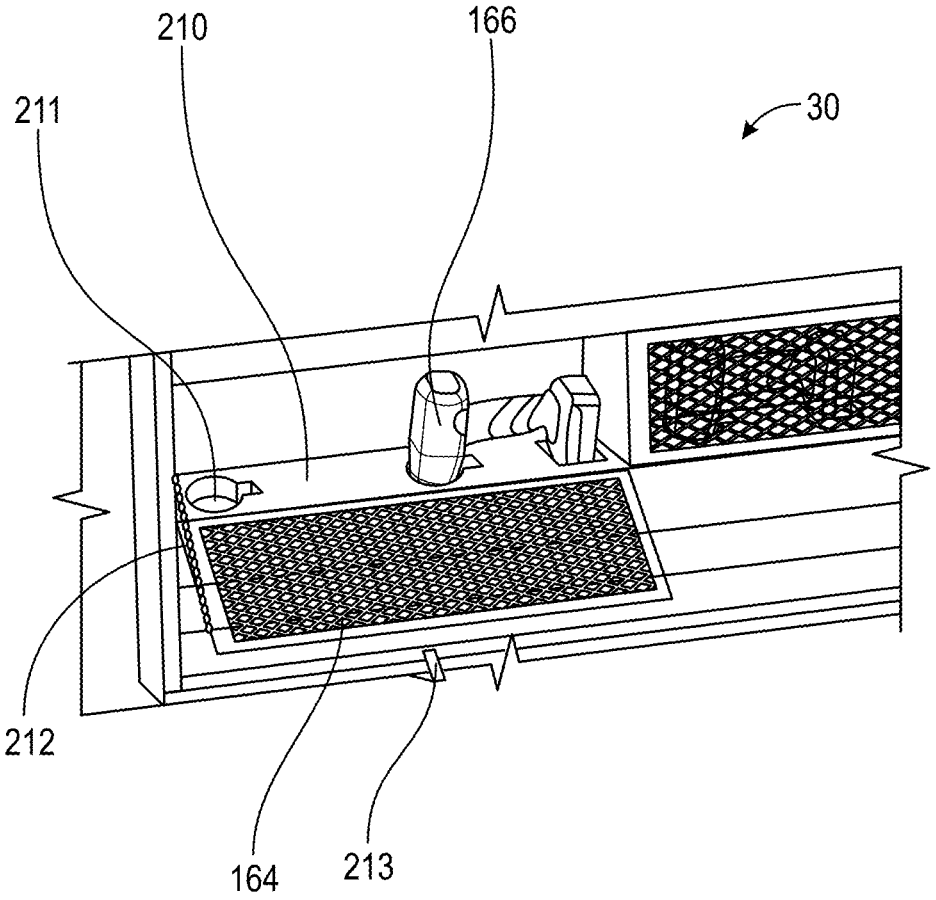
FIG. 11A illustrates a partial perspective view of a lid of a chest with a bolster having a tool opening in accordance with an example embodiment.
Figure 11B:
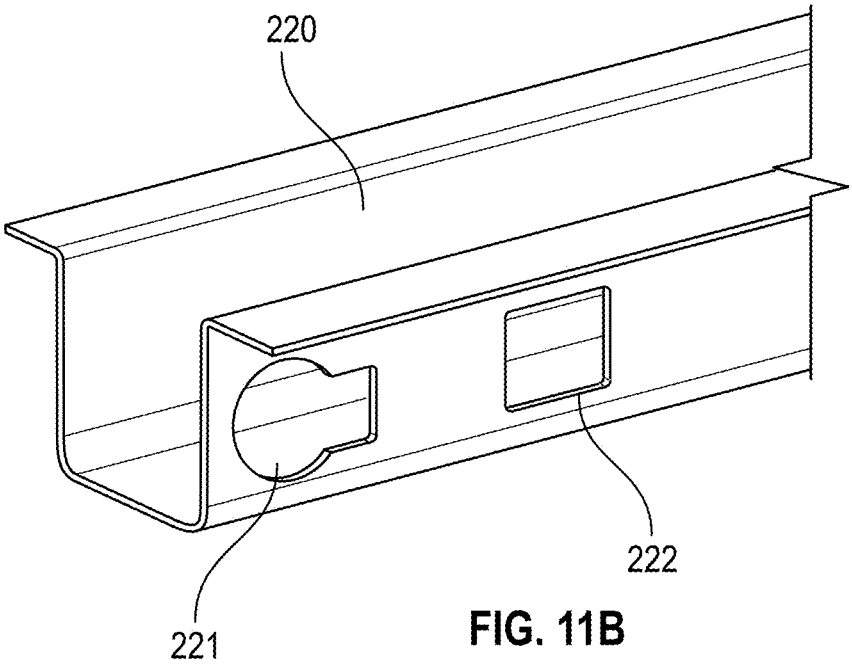
FIGS. 11B and 11C illustrate partial perspective views of a bolster having a tool opening in accordance with an example embodiment.
Figure 11C:
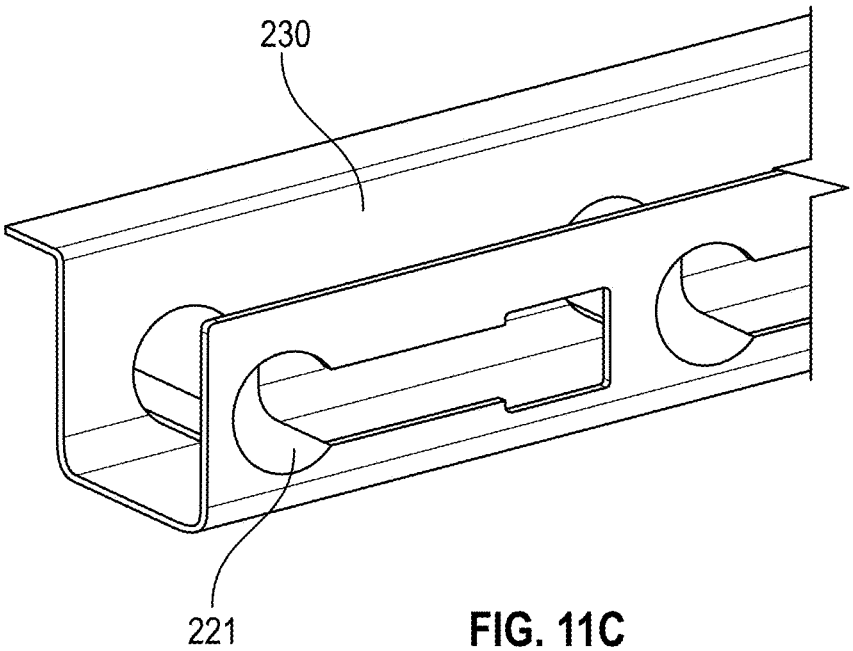

Another example storage feature that may be disposed in the secondary compartment 100 in the lid 30 is shown in FIG. 11A. FIG. 11A provides a perspective partial view of a variation of a lid 30 with a lid storage compartment having the door 164 as described above. A chain or non-rigid support 212 may be included to stop the swivel motion of the door 164 at a desired position. The door 164 may also include a mechanical or magnetic latch 213. A bolster 210 may form the lower wall of the lid storage compartment, and the openings 211 may be cut (e.g., die cut) into the bolster 210 that receive portions of a tool (e.g., power tool 166). The opening 211 may be circular with a rectangular extended portion similar to a tear drop shape that is designed to receive the nose of a power tool. Alternatively, as shown in FIG. 11B, an alternative bolster 220 is shown with an opening 221 (e.g., which may be circular with a rectangular extended portion similar to a tear drop shape) may be formed in the bolster 220 together with an additional opening 222 (e.g., rectangular in shape). The opening 221 may be formed to receive the nose of the power tool while the opening 222 may be formed to receive the base or battery pack of the power tool. In yet another alternative, as shown in FIG. 11C, another bolster 230 may be used that includes a single opening 231 for each tool. In this regard, the opening 231 may include a circular portion, a rectangular portion, and a narrow rectangular extended portion disposed between the wider rectangular portion and the circular portion, thus taking a dog bone shape. The circular portion of the opening 231 may be configured to receive the nose of a tool and the rectangular portion may be configured to receive a base or battery pack portion of the tool.

Figure 12:
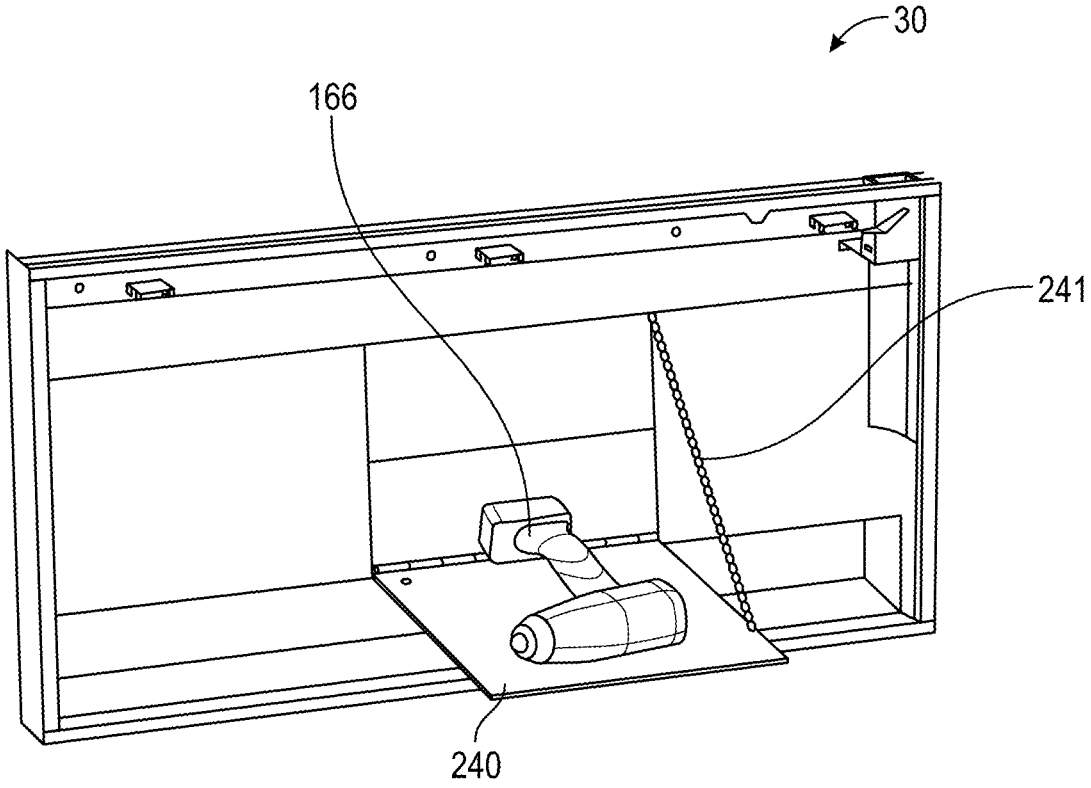
FIG. 12 illustrates a partial perspective view of a lid of a chest with a lid storage compartment having a door that secures a tool in accordance with an example embodiment.

Another example storage feature that may be disposed in the secondary compartment 100 in the lid 30 is shown in FIG. 12. A lid storage compartment is provided where the tool 166 may be supported by the door 240 (rather than, for example, a bolster). In this regard, the tool 166 may be temporarily tethered or otherwise temporarily attached to the door 240, such that, when the door 240 is opened, the tool 166 moves with the door 240 is readily accessible for removal and use by a user. To prevent the door 240 from falling completely open, a tether 241 (e.g., chain) may be affixed between the lid 30 and the door 240 to maintain the door 240 in a desired open position.

Figure 13A:
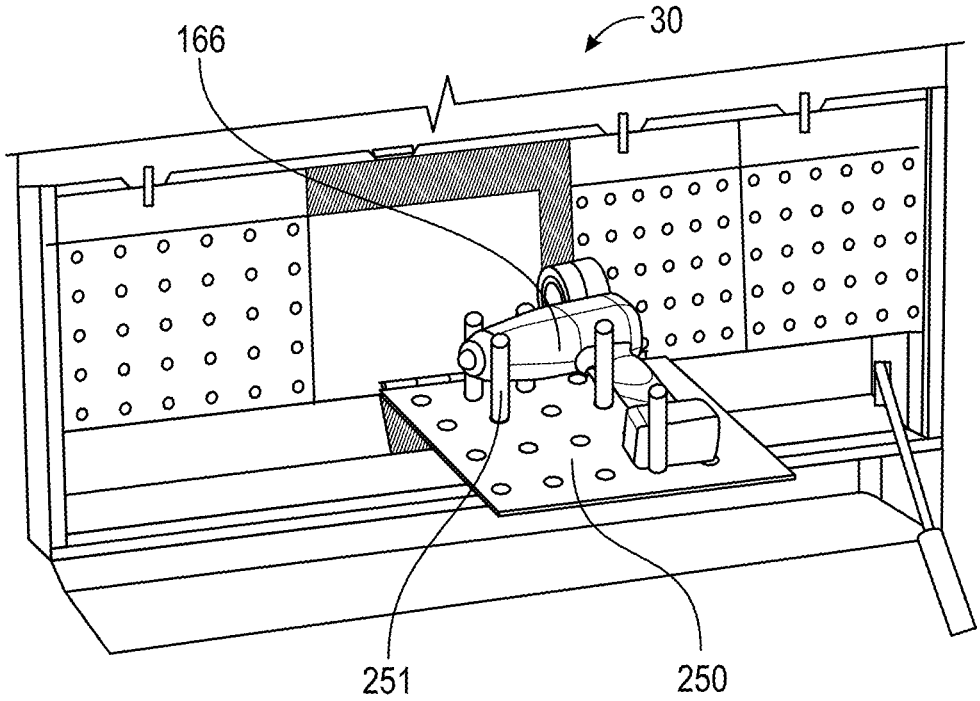
FIG. 13A illustrates a partial perspective view of a lid of a chest with a lid storage compartment having a peg board door that secures a tool in accordance with an example embodiment.
Figure 13B:
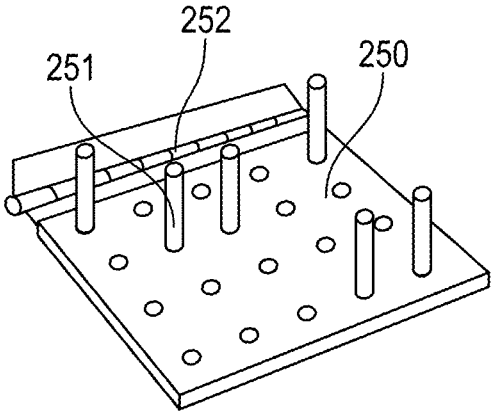
FIG. 13B illustrates a perspective view of a peg board door that secures a tool in accordance with an example embodiment.
Figure 13C:
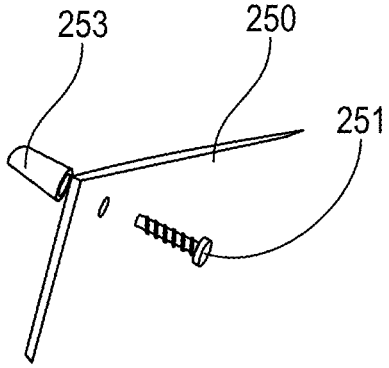
FIG. 13C illustrates a perspective view of a peg configured to be secured to a peg board door in accordance with an example embodiment.

According to some example embodiments, a technique for securing a tool to a door may be via selectively placed pegs on a door 250 that may include a peg board as shown in FIGS. 13A to 13C. In this regard, pegs 251 may be placed as seen in FIG. 13B to, for example, outline the shape of the tool that is to be received by the pegs 251. The peg board door 250 may be affixed to the lid 30 via a hinge 252. To hold the pegs in place on the peg board door 250, each peg 251 may be secured to the peg board door 250 by a respective cap 253.

Figure 14A:
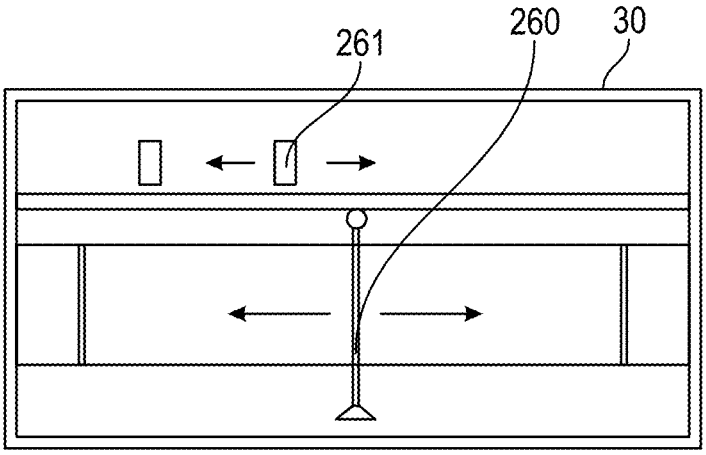
FIGS. 14A to 14C illustrate partial perspective views of a lid of a chest with a lid storage compartment having movable dividers in accordance with an example embodiment.
Figure 14B:
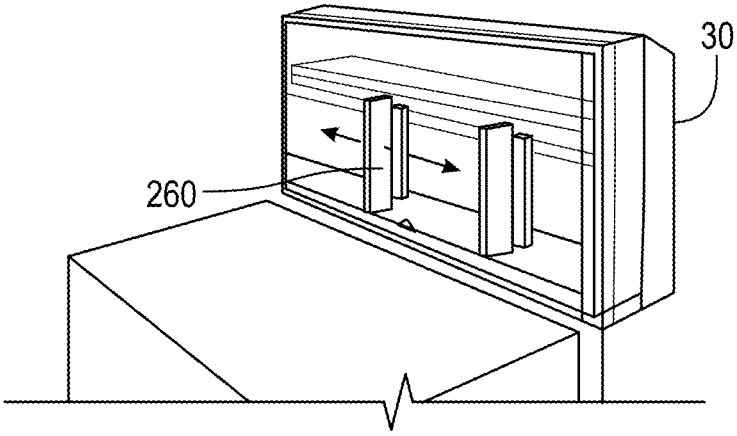
Figure 14C:
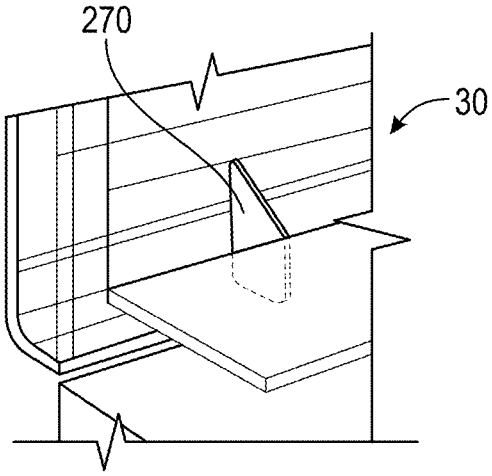

According to some example embodiments, the lid storage compartments may also include adjustable dividers to facilitate further organization with the compartments. In this regard, as shown in FIG. 14A, a divider 260 may be movable towards either side within the compartment space to create sub-compartments of a desired size as indicated by the arrows. Similarly, according to some example embodiments, the hooks 261 may also be adjustable to accommodate items of a certain size or shape. Similarly, in FIG. 14B, the divider 260 is again shown as being movable to separate the sub-compartments a desired amount. Also, as shown in FIG. 14C, a short divider 270 may alternatively or additional used. Adjustability may be provided via attachment of the divider 260, divider 270, or hooks 261 to openings or slots in the bolsters or the like and complementary pegs or tabs on the dividers 260 or the hooks 261.

Figure 15:
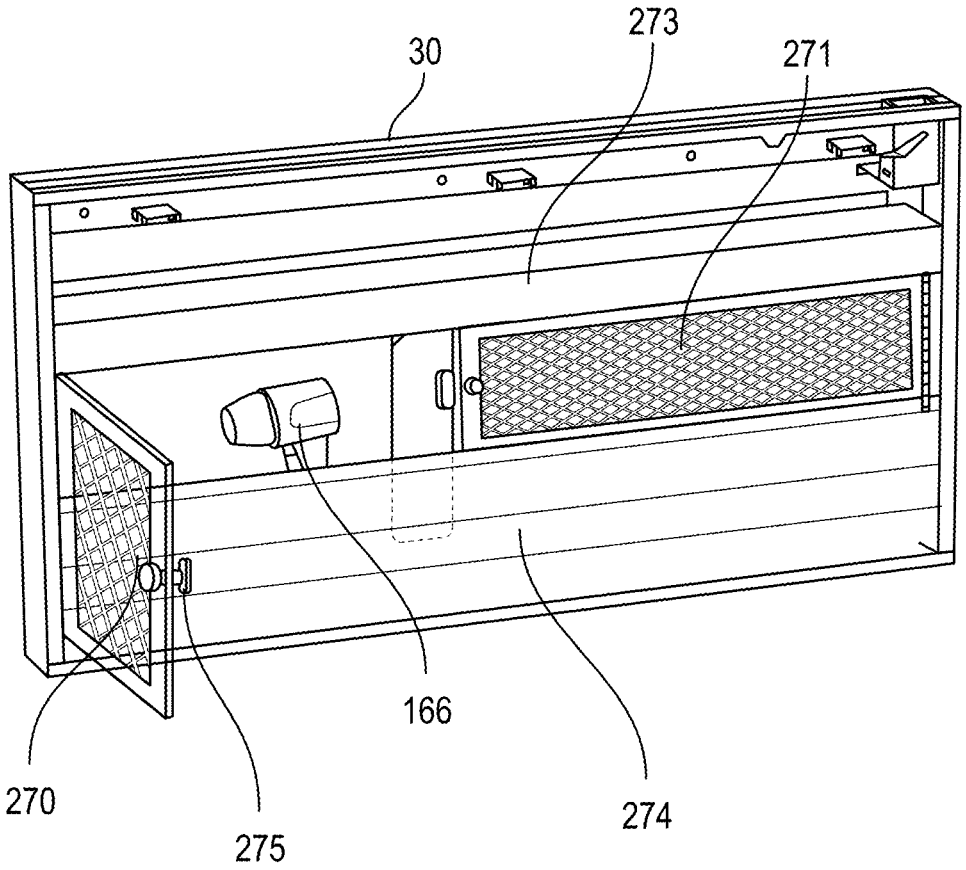
FIG. 15 illustrates a perspective view of a lid of a chest with a lid storage compartment having side-open doors in accordance with an example embodiment.

With reference to FIG. 15, another example lid storage compartment with a tool 166 stored therein is shown. The lid storage compartment may be formed between an upper bolster 273 and a lower bolster 274. In this regard, the doors 270, 271 have side hinges that cause the doors 270, 271 to open to the side (i.e., horizontally), rather than downward as described above. These side open doors 270 and 271 may include a mesh design to permit viewing of the items stored within the compartment. Further, each door 270 and 271 may include a respective mechanical or magnetic latch 275 configured to maintain the doors 270 and 271 in the closed position, for example, when the lid 30 is closed.

Figure 16A:
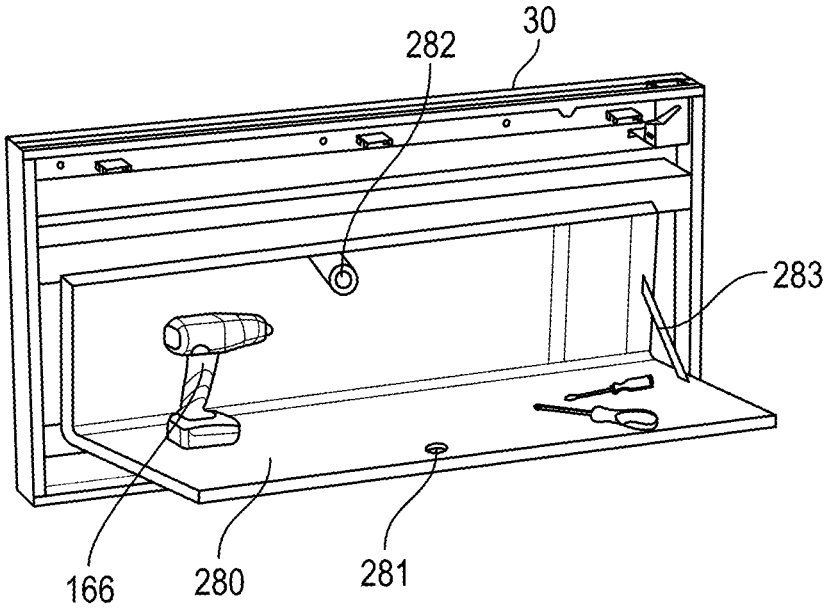
FIGS. 16A and 16B illustrate perspective views of a lid of an example chest with a lid storage compartment having a door that is configured to operate as a shelf or work bench in accordance with an example embodiment.
Figure 16B:
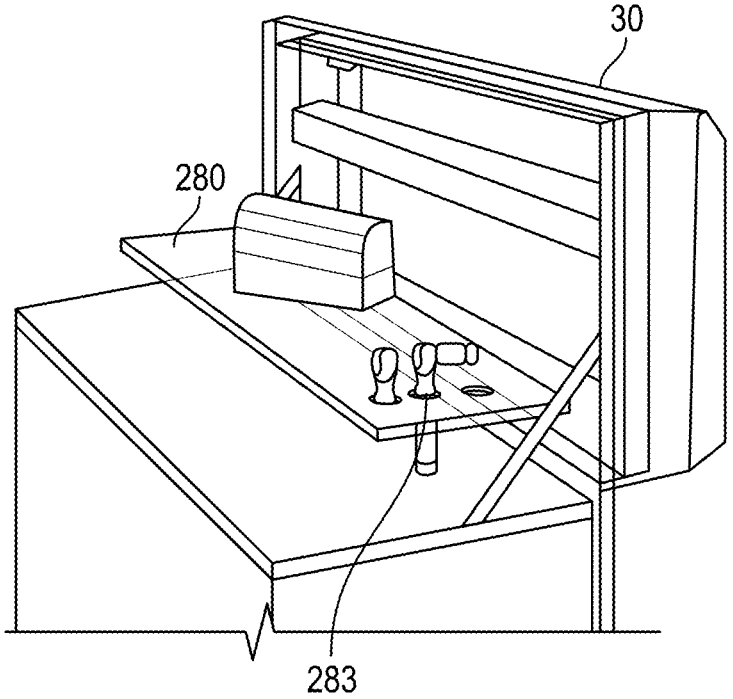

Another example storage feature that may be disposed in the secondary compartment 100 in the lid 30 is shown in FIG. 16A. In this regard, a lid storage compartment is provided where the door 280 is solid and operates also as a shelf or work bench when the door 280 is in the open position. A mechanical or magnetic latching mechanism may be used to maintain the door 280 in a closed position, for example, when the lid 30 is also closed. To increase the sturdiness of the door 280 while in the open position, a support bar 283 may be used between the door and the lid 30. As shown in FIG. 16B, the door 280 may include openings 283 for receiving, for example, certain hand tools to facilitate organization when the door 280 is in the open position. Further, door 280 may include a mechanical or magnetic latch 282 configured to engage with opening 281 maintain the door 280 in the closed position, for example, when the lid 30 is closed.

Figure 17A:
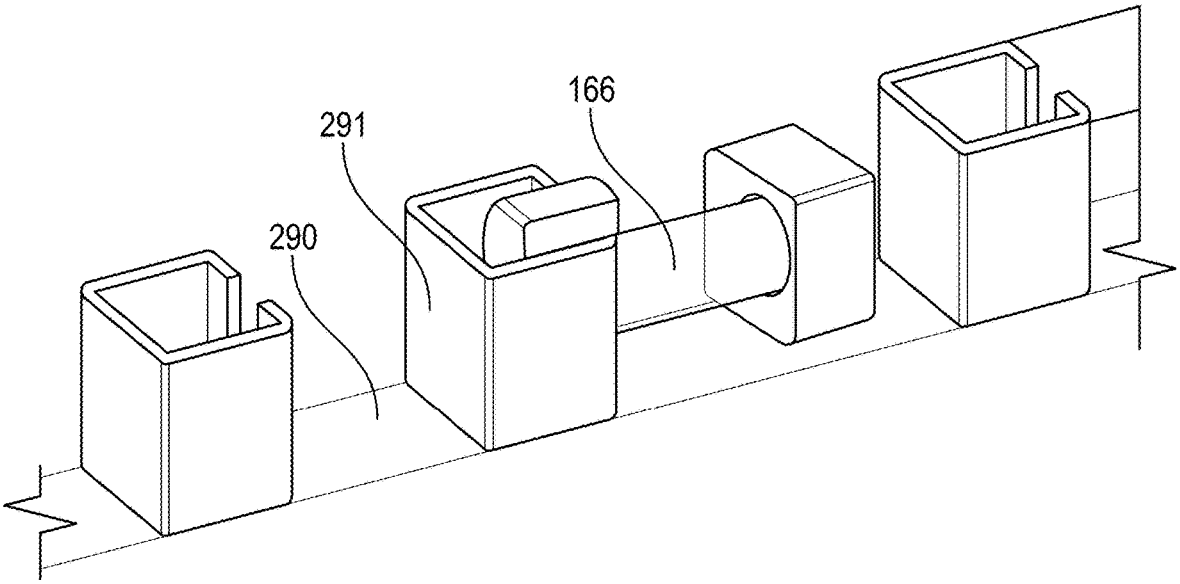
FIG. 17A illustrates a partial perspective view of a bolster having a tool opening and a sleeve in accordance with an example embodiment.
Figure 17B:
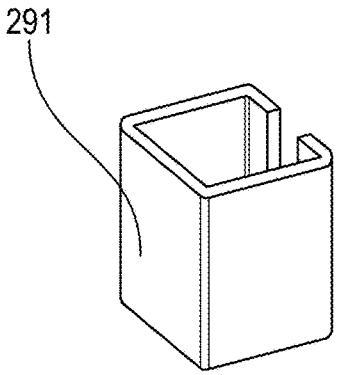
FIG. 17B illustrates a perspective view of a tool securing sleeve in accordance with an example embodiment.
Figure 17C:
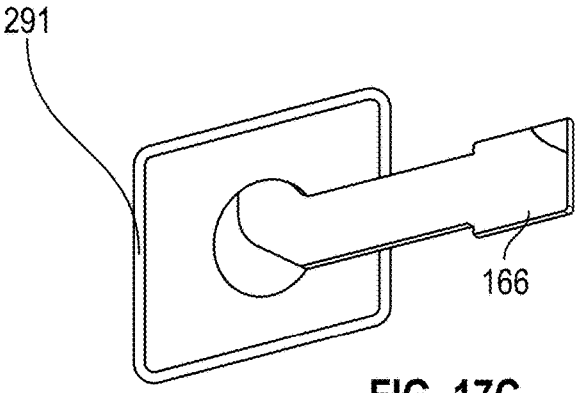
FIG. 17C illustrates a top view of a tool secured within a sleeve in accordance with an example embodiment.

According to another example embodiment, as shown in FIGS. 17A to 17C, an alternative bolster 290 may be used. In this regard, the bolster 290 may include at least one opening for receiving a tool 166. However, a sleeve 291 may be affixed to the bolster 291 around the opening to facilitate holding the power tool 166 in position. The sleeve 291 may include a slot for receiving the handle of the tool 166 and permitting the handle to extend out of the slot as shown in the overhead view of FIG. 17C. According to some example embodiments, the tool 166 may be press fit into the sleeve 291 to secure the tool 166.

Figure 18A:
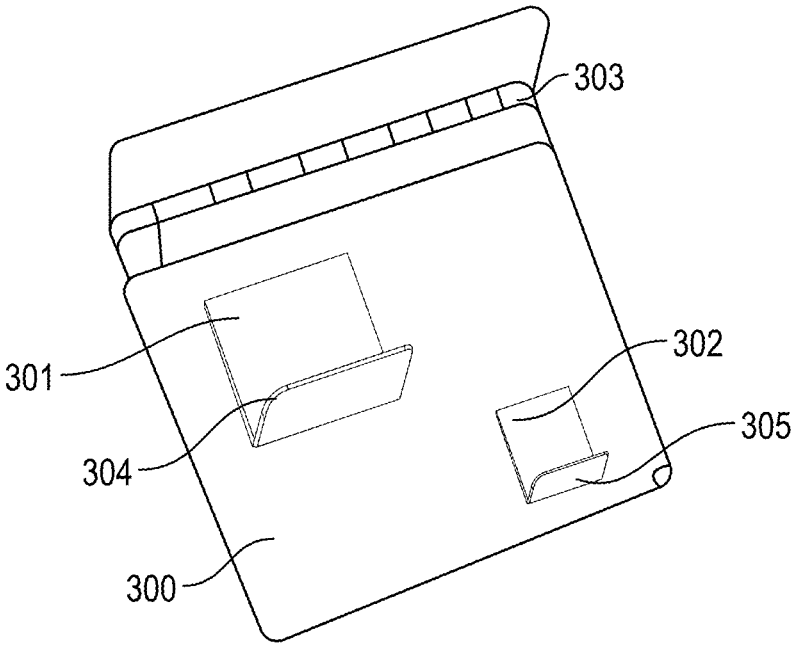
FIG. 18A illustrates a perspective view of a door that secures a tool in accordance with an example embodiment.
Figure 18B:
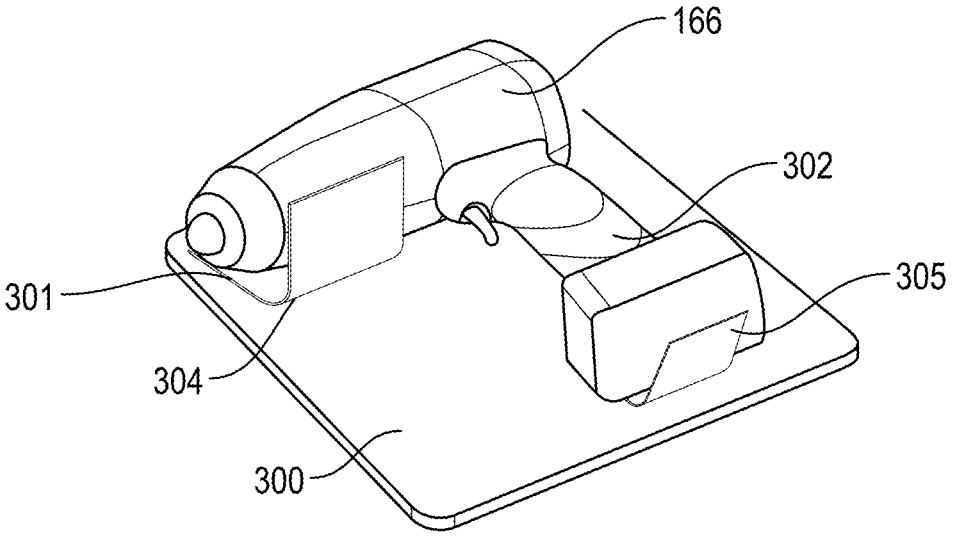
FIG. 18B illustrates a perspective view of a door securing a tool in accordance with an example embodiment.

Another alternative door 300 of a lid storage compartment is provided in FIGS. 18A and 18B. In this regard, the door 300 may be affixed to the lid 30 via the hinge 303. Further, the openings 301 and 302 may be strategically positioned on the door 300 to receive protrusions of the tool 166. In addition to the openings, support tabs 304 and 305 may be positioned below the openings to hold the tool 166 and prevent the tool 116 from falling, for example, when the door 300 is open. As shown in FIG. 18B, the tool 166 may be positioned on the door 300 such that certain protrusions of the tool 166 are received into the openings 301 and 302 and the tool 166 rests on the support tabs 304 and 305.

FIGS. 19A to 22B illustrate another example embodiment that is a variation of the chest 10 with a lid 30. FIGS. 19A to 19C show an example of chest 10 with the lid 30 in the open position and a door 111 of a lid storage compartment in the closed position. As such, the secondary compartment 100 includes an example lid storage compartment 110 where the door 111 of the lid storage compartment is solid (e.g., does not include mesh as described above). The door 111 may be moved between an open position and a closed position by pivoting at the hinge 112. The hinge 112 may be affixed to the door 111 at a lower edge of the door 111 (e.g., adjacent the rear panel 34 of the lid 30) and to the well panel 114. The door 111 may extend horizontally between the compartment side panels 117 and vertically (when the lid 30 is in the open position) from adjacent the rear panel 34 to the bolster 113.

According to some example embodiments, the example chest 10 of FIG. 19A may include a support strut 411. The support strut 411 may be affixed to a sidewall 16 (at a lower end) and a compartment side panel 117 (at an upper end). According to some example embodiments, the support strut 411 may include a spring that operates to urge the lid 31 into the raised position. As such, the spring of the support strut 411 may be sized to support the weight of the lid 30 and the weight of the expected contents of the lid 30. Alternatively, the support strut 411 may be a hydraulic or pneumatic piston that operates to slow the closing speed of the lid 30. In this regard, the support strut 411 may be configured to prevent the lid 30 from falling or slamming into the closed position.

According to some example embodiments, the example chest 10 may also include a grommet 413. In this regard, the grommet 413 may be an opening in a wall (e.g., rear wall 18) of the chest 10. The grommet 413 may be sized to permit a plug of an extension cord or outlet bank (e.g., power strip) to pass through the grommet 413. As such, the grommet 413 may permit items (e.g., tools) within the primary compartment 21 or the secondary compartment 110 to be powered, particularly when the lid 30 is in the closed position. For example, battery or tool chargers may be placed within the chest 10 that are powered via a cord passing through the grommet 413 to permit charging of batteries or tools while the lid 30 is in the closed position (and possibly locked, overnight). A tray 412 may also be included proximate the grommet 413 to hold, for example, an outlet bank or the like off of the floor 12 of the chest 10.

Figure 19B:
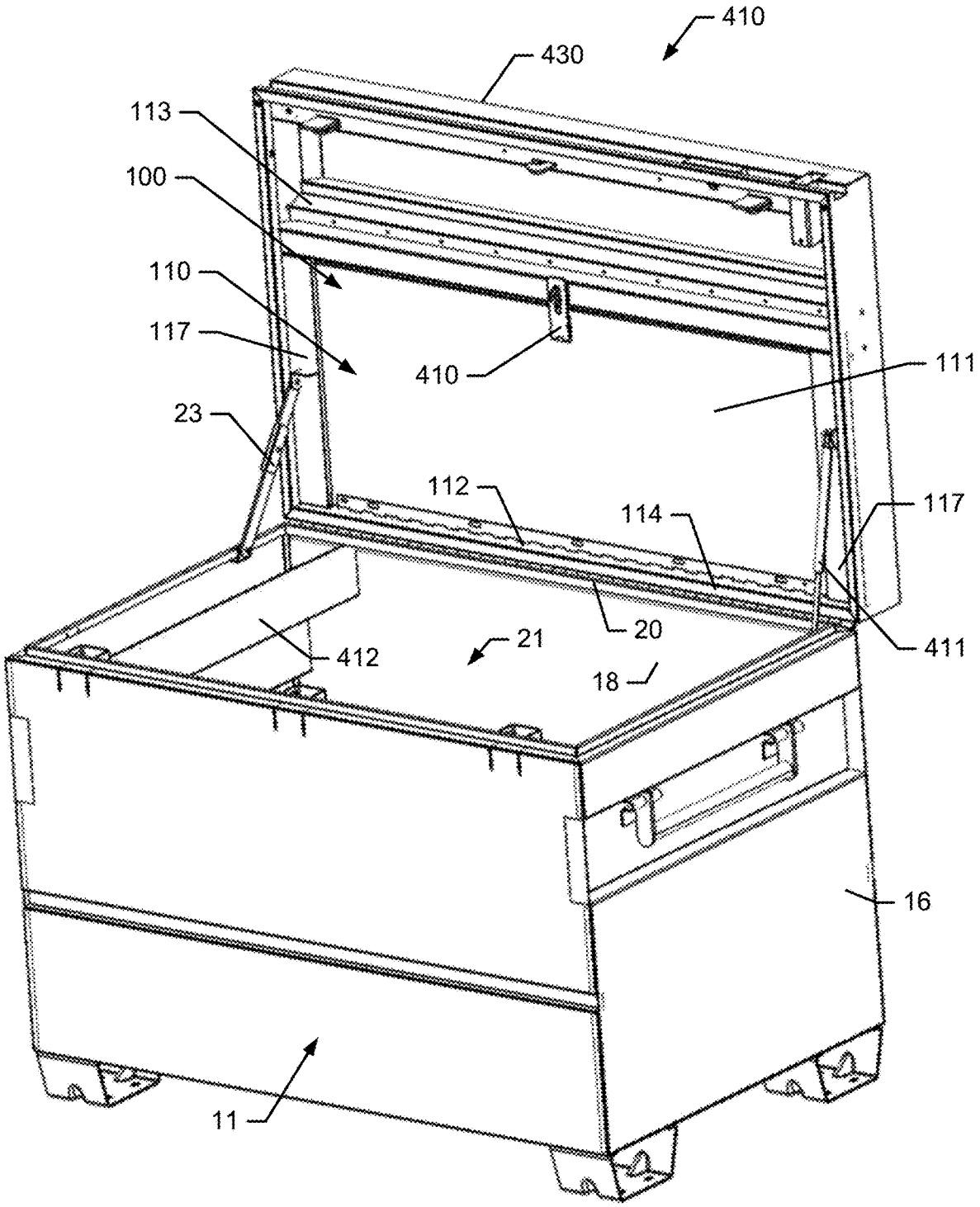
Figure 19C:
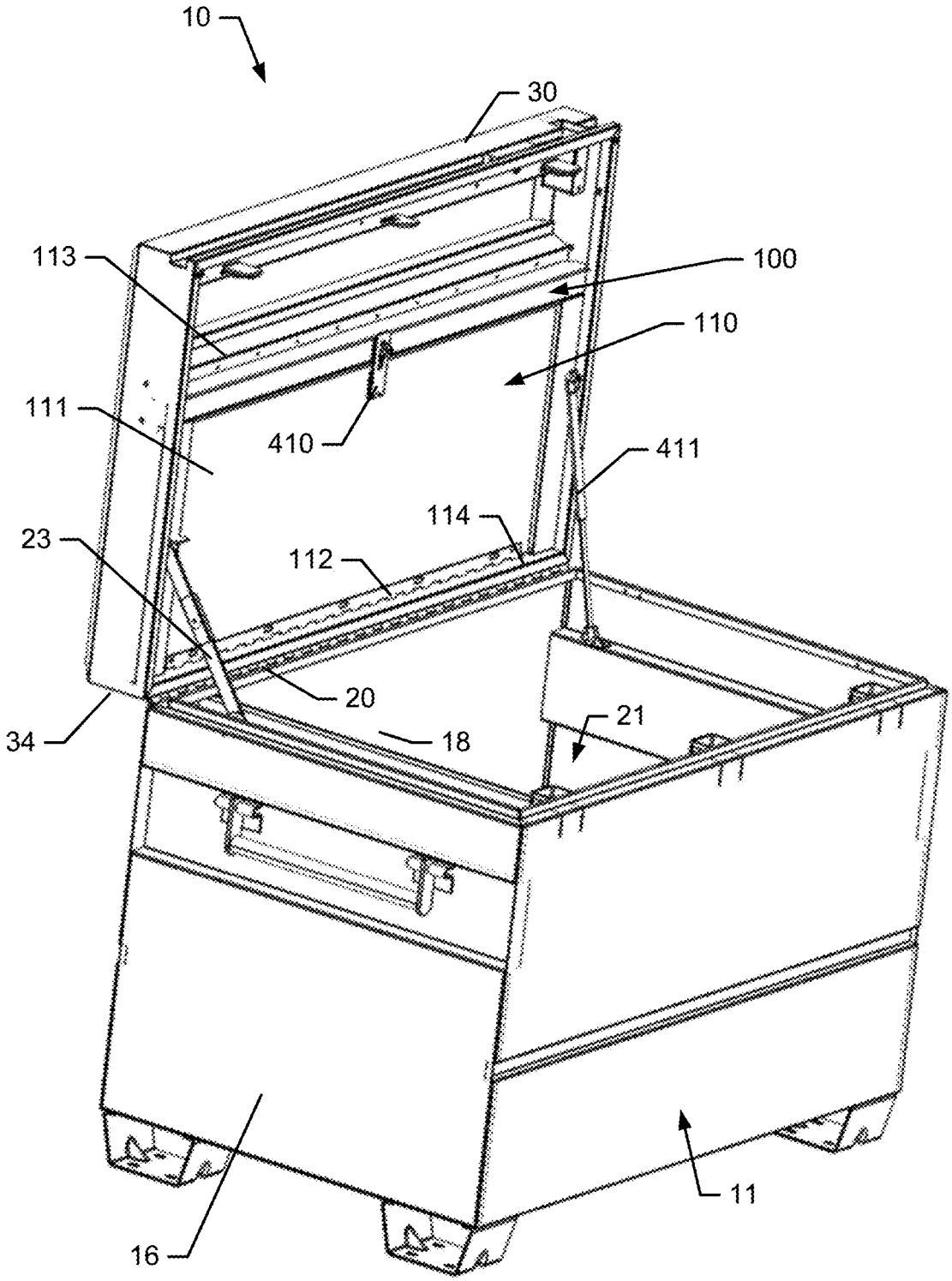

Referring back to the secondary compartment 110 and the door 111, as shown in FIGS. 19A to 19C, a hasp 410 may be affixed to the door 111 and the bolster 113. The hasp 410 may operate to hold the door 111 in the closed position and also provide a mechanism for locking the door 111 and securing the contents of the lid storage compartment 110. In this regard, with the hasp 410 in the coupled configuration, a lock shackle may be passed through an eyelet portion of the hasp 410 to lock the door 111 in the closed position.

Figure 20A:
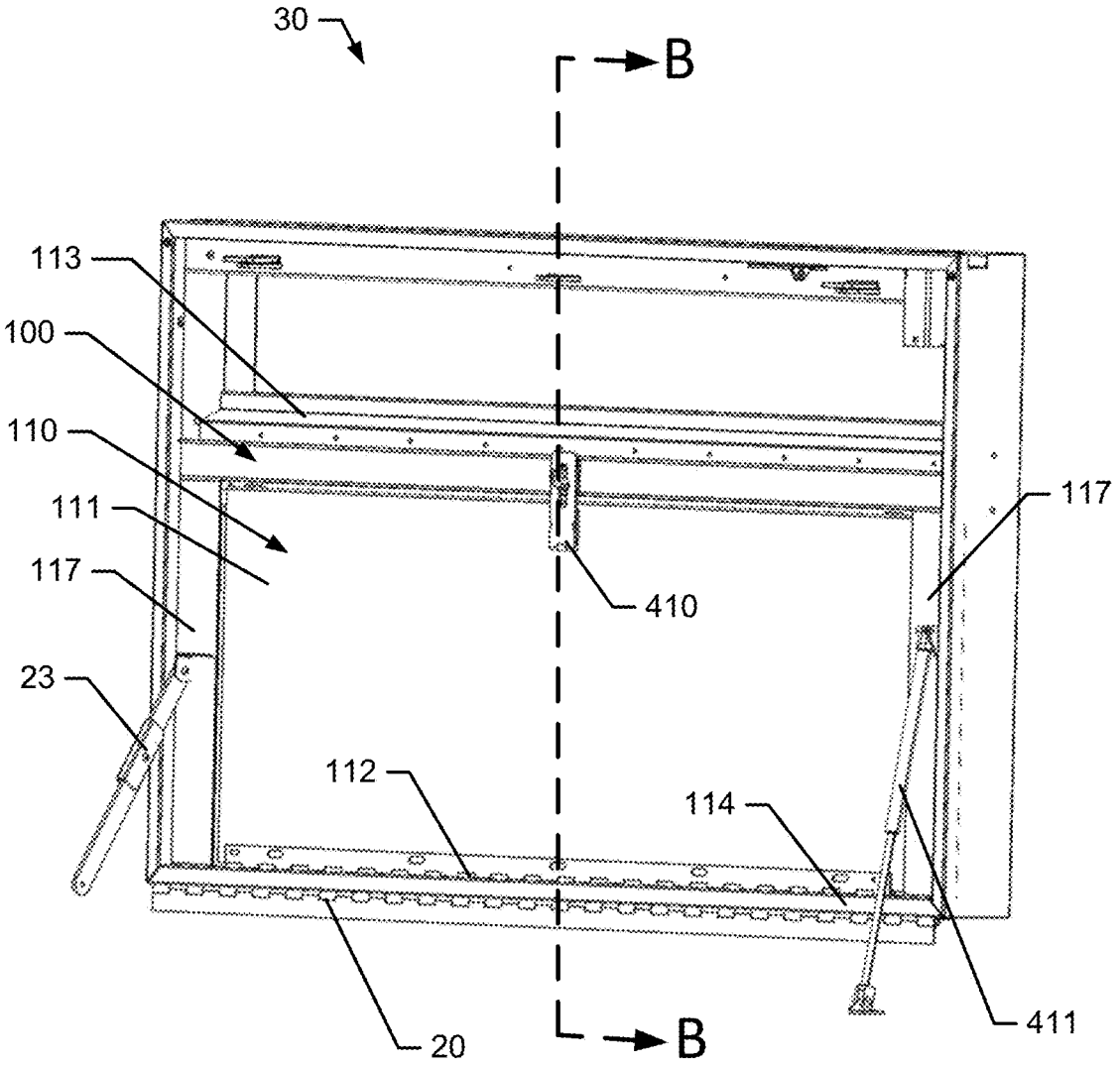
FIG. 20A illustrates a perspective view of the lid of the chest of FIG. 19A in accordance with and example embodiment.
Figure 20B:
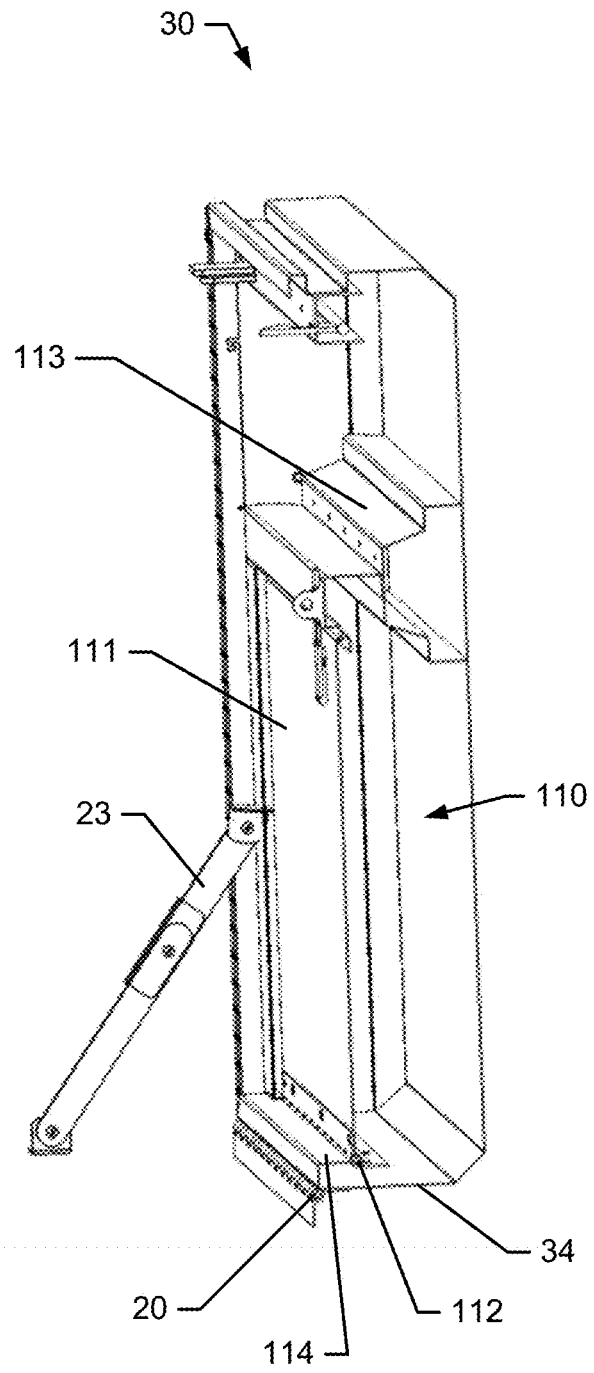
FIG. 20B illustrates a perspective cross-section view of the lid of FIG. 19A taken at B-B of FIG. 20A with the door for the lid storage compartment in a closed position in accordance with an example embodiment.

FIGS. 20A and 20B illustrate the lid 30 in isolation with the door 111 in the closed position. FIG. 20B shows a cross-section side view of the lid 30 taken at B-B illustrating the lid storage compartment 110 with the door 111 closed. As can be best seen in FIG. 20B, the well panel 114 is L-shaped and is welded or otherwise attached to the rear panel 34, as well as to the hinge 112. Also depicted in FIG. 20B is the bolster 113 which includes an extended portion that forms a portion of the upper wall of the lid storage compartment 110. An eyelet portion of the hasp 410 may be affixed to the bolster 113. Further, the bolster 113 may include a series of openings across the bolster's length that may operate as connection points for other storage features such as hooks or the like.

Figure 21:
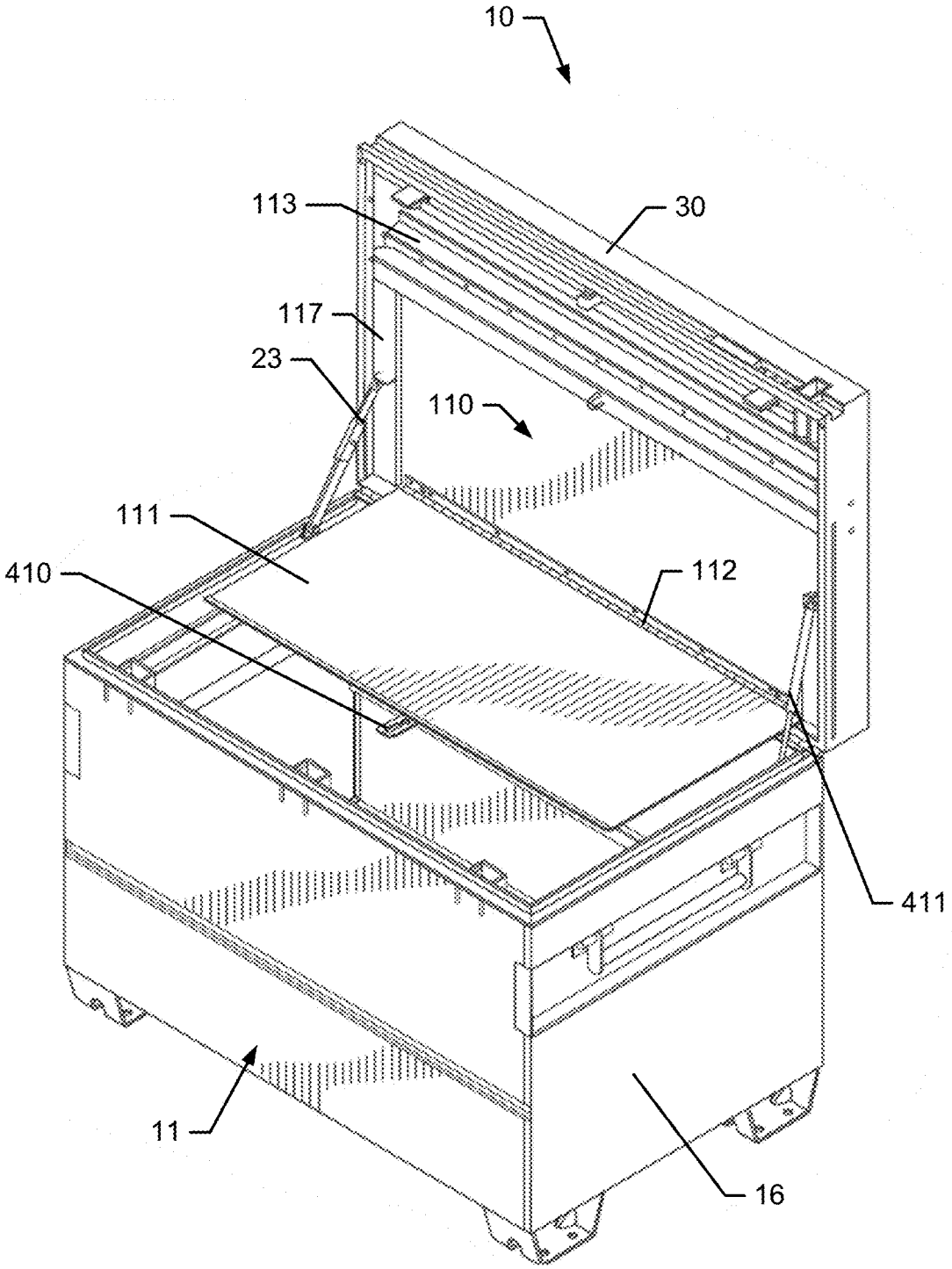
FIG. 21 illustrates a perspective view of the chest of FIG. 19A with the door for the lid storage compartment in an open position in accordance with an example embodiment.

FIG. 21 illustrates the example chest 10 of FIG. 19A with the door 111 of the lid storage compartment 110 in the open position. FIG. 22A shows the lid 30 in isolation with the door 111 in the open position. Further, FIG. 22B shows a cross-section view of the lid 30 with the door 111 in the open position taken at C-C. As can be seen in FIGS. 21 to 22B, the hasp 410 has been decoupled to permit the door 111 to be opened.

According to some example embodiments, a storage chest is provided that may comprise a box portion comprising a front wall, a rear wall, and a floor attached to the front and rear walls to form a primary compartment for storage of items. The storage chest may further comprise a lid comprising a front panel, a rear panel, and a top panel attached to the front a rear panels. The rear panel may be pivotably coupled to the rear wall of the box portion. The front panel, the rear panel, and the top panel may define a secondary compartment within the lid. The secondary compartment may include a lid storage compartment comprising a hingedly affixed door. According to some example embodiments, the lid storage compartment may further comprise a bolster that provides structural support to the lid and forms a portion of a wall of the lid storage compartment. Additionally or alternatively, a ratio of the volume of the primary compartment to a volume of the secondary compartment may be between 8 to 1 and 12 to 1. Additionally or alternatively, the door may be rigid and may comprise a mesh pattern such that items stored in the lid storage compartment are viewable. Additionally or alternatively, the door may be affixed to a well panel via a hinge. The well panel providing a depth to the lid storage compartment. Additionally or alternatively, the door may comprise a mechanical or magnetic latch for securing the door in a closed position. Additionally or alternatively, the door may be affixed to a lid storage compartment hinge. The lid storage compartment hinge may be disposed in parallel with a lid hinge that couples the rear panel of the lid to the rear wall of the box portion. Additionally or alternatively, the secondary compartment may further comprise one or more hooks disposed outside of the lid storage compartment for securing items within the secondary compartment. Additionally or alternatively, the storage chest may further comprise a locking mechanism configured to lock the lid of the storage chest to the box portion of the storage chest. Additionally or alternatively, the storage chest may further comprise a plurality of feet configured to raise the box portion to permit a forklift to move under the box portion to facilitate movement of the chest.

According to some example embodiments, another storage chest is provided. The storage chest may be comprise a box portion comprising a front wall, a rear wall, and a floor attached to the front and rear walls to form a primary compartment for storage of items. The storage chest may further comprise a lid comprising a front panel, a rear panel, and a top panel attached to the front a rear panels. The rear panel may be pivotably coupled to the rear wall of the box portion. The front panel, the rear panel, and the top panel may define a secondary compartment within the lid for storage of items. The secondary compartment may include a bolster that provides structural support to the lid. The secondary compartment may include a lid storage compartment. A wall of the lid storage compartment may be formed by the bolster. According to some example embodiments, the bolster may comprise an opening that is disposed behind a hingedly affixed door. Additionally or alternatively, the door may be rigid and may comprise a mesh pattern such that items stored behind the door are viewable. Additionally or alternatively, the door may be affixed to a well panel via a hinge. The well panel may provide a depth to the lid storage compartment that is accessible via the door. Additionally or alternatively, the door may comprise a mechanical or magnetic latch for securing the door in a closed position. Additionally or alternatively, the door may be affixed to a lid storage compartment hinge. The lid storage compartment hinge may be disposed in parallel with a lid hinge that couples the rear panel of the lid to the rear wall of the box portion. Additionally or alternatively, the secondary compartment may further comprise one or more hooks disposed outside of the lid storage compartment that is accessible via the door. The one or more hooks may be configured to secure items within the secondary compartment. Additionally or alternatively, the storage chest may further comprise a locking mechanism configured to lock the lid of the storage chest to the box portion of the storage chest. Additionally or alternatively, the storage chest may further comprise a plurality of feet configured to raise the box portion to permit a forklift to move under the box portion to facilitate movement of the chest. Additionally or alternatively, a ratio of the volume of the primary compartment to a volume of the secondary compartment may be between 8 to 1 and 12 to 1.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tool storage chest comprising:

a box portion comprising a front wall, a rear wall, and a floor attached to the front and rear walls to form a primary compartment for storage of items;

a lid comprising a front panel, a rear panel, and a top panel attached to the front and rear panels, the rear panel being pivotably coupled to the rear wall of the box portion; and a lid storage compartment comprising:

a compartment wall that is a portion of an interior surface of the top panel of the lid;

a compartment hinge; and a compartment door affixed to the compartment hinge and configured to pivot to a position that is substantially parallel to the floor when the lid is in a lid open position so that the compartment door can function as a shelf or workbench when the lid is in the lid open position and the compartment door is in a door open position.

2. The tool storage chest of claim 1, wherein the lid storage compartment further comprises a support affixed to the compartment door, the support being configured to stop pivoting of the compartment door at a desired position.

3. The tool storage chest of claim 2, wherein the support is a non-rigid support.

4. The tool storage chest of claim 3, wherein the non-rigid support comprises a chain or other tether.

5. The tool storage chest of claim 1, wherein the lid further comprises a bolster that provides structural support to the lid; and wherein the bolster is a second compartment wall of the lid storage compartment.

6. The tool storage chest of claim 5, wherein the lid storage compartment comprises a latch or hasp extending from the compartment door to the bolster.

7. The tool storage chest of claim 5, wherein the lid storage compartment comprises a hasp extending from the compartment door to the bolster;

wherein the hasp is configured to receive a lock shackle to permit the compartment door of the lid storage compartment to be locked separately from the box portion of the tool storage chest.

8. The tool storage chest of claim 5, wherein, when the lid is in the lid open position, the lid storage compartment is disposed below the bolster;

wherein the tool storage chest further comprises another storage compartment disposed above the bolster when the lid is in the lid open position.

9. The tool storage chest of claim 5, wherein the lid storage compartment further comprises:

a first compartment side panel extending between the rear wall and the bolster on a first side of the lid storage compartment; and a second compartment side panel extending between the rear wall and the bolster on a second side of the lid storage compartment;

wherein the compartment door is positioned between the first compartment side panel and the second compartment side panel when the compartment door is in a door closed position.

10. The tool storage chest of claim 9 further comprising a lid support bar extending from a sidewall of the box portion to the first compartment side panel.

11. The tool storage chest of claim 9 further comprising a lid support strut extending from a sidewall of the box portion to the second compartment side panel.

12. The tool storage chest of claim 1, wherein the lid storage compartment comprises a well panel that forms a cavity portion of the lid storage compartment disposed between an interior surface of the well panel and the interior surface of the top panel; and wherein the cavity portion is configured to receive and maintain items during opening and closing of the lid.

13. The tool storage chest of claim 12, wherein the compartment hinge is affixed to the well panel.

14. The tool storage chest of claim 1, further comprising:

a lid support coupling the box portion and the lid and configured to hold the lid in the lid open position where the top panel of the lid is substantially perpendicular to the floor; and a door support coupling the lid and the compartment door and configured to hold the compartment door in the door open position where the compartment door is substantially perpendicular to the lid when the lid is in the lid open position and the compartment door is in a door open position.

15. The tool storage chest of claim 14, wherein the lid support comprises a spring for urging the lid into the lid open position, and wherein the piston is sized at least in part based on weight of the lid and weight of expected contents of the lid storage compartment.

16. The tool storage of claim 14, wherein the lid support comprises a piston that operates to slow the closing speed of the lid, and wherein the piston is sized based on weight of the lid and weight of expected contents of the lid storage compartment.

17. The tool storage chest of claim 14, wherein the door support comprises a non-rigid support member.

18. The tool storage chest of claim 1, wherein the compartment door is configured so that it can be locked to secure the contents of the compartment even when the lid is in the lid open position.

19. The tool storage chest of claim 1, further comprising a mechanical or magnetic latch configured to hold the compartment door in a door closed position.

20. The tool storage chest of claim 1, wherein the compartment hinge is located proximate to the lower edge of the compartment door and the lid, and wherein the compartment door is configured to be lowered by a user to the door open position when the lid is in the lid open position.

21. The tool storage chest of claim 1, wherein the box portion, the lid, and the lid storage compartment are each made primarily of metal.

22. The tool storage chest of claim 1, wherein the compartment door comprises mesh so that contents of the lid storage compartment can be at least partially visible from the outside when the compartment door is in a door closed position and the lid is in the lid open position.

23. The tool storage chest of claim 1, wherein the compartment door is solid so that contents of the lid storage compartment are not visible when the compartment door is in a door closed position and the lid is in the lid open position.

24. The tool storage chest of claim 1, wherein the compartment door comprises cutouts, tabs, or supports for holding tools thereon when the compartment door is in the door open position.

* * * * *